US009907363B2

(12) United States Patent
Smith et al.

(10) Patent No.: US 9,907,363 B2
(45) Date of Patent: Mar. 6, 2018

(54) STRAP SECURING SYSTEMS FOR ARTICLES OF FOOTWEAR AND OTHER FOOT-RECEIVING DEVICES

(71) Applicant: Nike, Incorporated, Beaverton, OR (US)

(72) Inventors: Mark J. Smith, Portland, OR (US); Adam R. Welliver, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 85 days.

(21) Appl. No.: 14/691,792

(22) Filed: Apr. 21, 2015

(65) Prior Publication Data

US 2016/0309844 A1 Oct. 27, 2016

(51) Int. Cl.

| | |
|---|---|
| ***A43C 11/14*** | (2006.01) |
| ***A43B 3/12*** | (2006.01) |
| ***A43B 5/00*** | (2006.01) |
| ***A43B 7/20*** | (2006.01) |

(52) U.S. Cl.

CPC ..... *A43C 11/1493* (2013.01); *A43B 3/126* (2013.01); *A43B 5/00* (2013.01); *A43B 7/20* (2013.01)

(58) Field of Classification Search

CPC ..... A43C 11/14; A43C 11/1493; A43C 11/00; A43C 11/20; A43C 1/00; A43C 1/04; A43C 1/003; A43C 1/006; A43B 7/14; A43B 7/18; A43B 7/19; A43B 7/20; A43B 3/126; A43B 23/02

See application file for complete search history.

(56) References Cited

U.S. PATENT DOCUMENTS

| | | | | | |
|---|---|---|---|---|---|
| 835,068 | A * | 11/1906 | Johnston Hl | ..... | A43C 1/04 24/683 |
| 4,621,648 | A * | 11/1986 | Ivany | ..... | A43B 5/00 36/89 |
| 4,640,025 | A * | 2/1987 | DeRenzo | ..... | A43C 11/1493 36/114 |
| 4,811,498 | A * | 3/1989 | Barret | ..... | A43B 5/0411 36/117.2 |

(Continued)

FOREIGN PATENT DOCUMENTS

CH 132292 A 4/1929

OTHER PUBLICATIONS

Sep. 13, 2016—(WO) Internattional Search Report and Written Opininon—App PCT/US2016/028327.

*Primary Examiner* — Megan Lynch
(74) *Attorney, Agent, or Firm* — Banner & Witcoff, Ltd.

(57) ABSTRACT

Articles of footwear or other foot-receiving devices include an upper/foot-covering member having medial and lateral strap tensioning components located on opposite sides of the ankle area. A securing system is provided that includes: (i) a first strap portion extending across the instep area, engaging the lateral strap tensioning component, and extending in front of the foot-insertion opening to the medial ankle side (where it may be secured), and (ii) a second strap portion extending across the instep area, engaging the medial strap tensioning component, and extending in front of the foot-insertion opening and to the lateral ankle side (where it may be secured). The first and second strap portions cross one another at two separated crossing locations.

24 Claims, 15 Drawing Sheets

(56) References Cited

U.S. PATENT DOCUMENTS 5,257,969 A * 11/1993 Mance ..... A61F 5/0113 36/8.3
5,269,078 A * 12/1993 Cochrane ..... A43B 5/00 36/170
D346,686 S * 5/1994 Hatfield ..... D2/973
5,400,529 A * 3/1995 Bell ..... A43B 5/00 36/114
5,659,982 A * 8/1997 Muraoka ..... A43B 3/0073 36/131
5,704,140 A * 1/1998 Fields ..... A43B 7/20 36/132
5,822,887 A * 10/1998 Turner ..... A43B 7/1495 36/132
5,894,684 A * 4/1999 Sand ..... A43B 7/20 36/115
6,021,585 A 2/2000 Cole
6,052,921 A * 4/2000 Oreck ..... A43C 1/00 36/50.1
6,073,370 A * 6/2000 Okajima ..... A43B 5/04 36/50.1
6,272,772 B1 * 8/2001 Sherman ..... A43B 5/16 36/89
6,286,233 B1 * 9/2001 Gaither ..... A43C 1/00 36/50.1
6,772,541 B1 * 8/2004 Ritter ..... A43B 7/14 36/50.1
8,225,530 B2 * 7/2012 Sokolowski ..... A43B 1/04 12/142 G
8,302,329 B2 11/2012 Hurd et al.
8,321,984 B2 12/2012 Dojan et al.
8,429,835 B2 4/2013 Dojan et al.
D683,112 S * 5/2013 James ..... D2/896
2002/0088144 A1 * 7/2002 Katz ..... A43C 11/14 36/88
2002/0148142 A1 * 10/2002 Oorei ..... A43B 5/00 36/129
2003/0066207 A1 * 4/2003 Gaither ..... A43C 1/04 36/50.1
2003/0167655 A1 * 9/2003 Sussmann ..... A43C 11/008 36/50.1
2004/0111923 A1 * 6/2004 Brooks ..... A43B 3/0063 36/89
2004/0134100 A1 * 7/2004 McVicker ..... A43B 1/0081 36/50.1
2005/0284002 A1 * 12/2005 Aveni ..... A43B 7/08 36/50.1
2007/0033836 A1 * 2/2007 Rasmussen ..... A43C 11/1493 36/50.1
2007/0068040 A1 * 3/2007 Farys ..... A43C 1/04 36/50.1
2007/0068041 A1 * 3/2007 Farys ..... A43B 5/0439 36/50.1
2008/0127511 A1 * 6/2008 Friton ..... A43C 1/00 36/50.1
2009/0071037 A1 * 3/2009 Foxen ..... A43B 7/20 36/89
2009/0247920 A1 * 10/2009 Clements ..... A61F 5/0127 602/27
2010/0299968 A1 * 12/2010 Matsueda ..... A43B 5/00 36/134
2012/0079741 A1 * 4/2012 Kohatsu ..... A43B 3/26 36/50.1
2012/0117821 A1 * 5/2012 Adams ..... A43B 3/0052 36/58.5
2012/0151795 A1 * 6/2012 Ivester ..... A43C 1/00 36/83
2013/0086815 A1 * 4/2013 Toraya ..... A43C 1/00 36/83
2013/0160328 A1 * 6/2013 Hatfield ..... A43B 23/02 36/103
2013/0205621 A1 * 8/2013 Torrance ..... A43B 5/14 36/114
2013/0247417 A1 9/2013 Nurse et al.
2013/0255105 A1 * 10/2013 Bishop ..... A43B 3/126 36/88
2014/0005585 A1 * 1/2014 Berns ..... A61F 5/0127 602/27
2014/0223779 A1 * 8/2014 Elder ..... A43C 1/04 36/103
2014/0338223 A1 * 11/2014 Adams ..... A43C 11/14 36/50.1
2015/0026937 A1 * 1/2015 Nonogawa ..... A43C 1/00 24/713.4
2015/0027004 A1 * 1/2015 Conrad ..... A43B 1/0081 36/102
2016/0029738 A1 * 2/2016 Llanes ..... A43B 3/242 36/89
2016/0120264 A1 * 5/2016 Bardini ..... A43C 1/00 36/50.1
2016/0219983 A1 * 8/2016 Taylor ..... A43B 3/0078
2016/0270484 A1 * 9/2016 Zadnik ..... A43B 23/0205

* cited by examiner

STRAP SECURING SYSTEMS FOR ARTICLES OF FOOTWEAR AND OTHER FOOT-RECEIVING DEVICES

FIELD OF THE INVENTION

The present invention relates to the field of footwear and other foot-receiving devices. More specifically, aspects of the present invention pertain to securing systems for articles of footwear and other foot-receiving devices that include crossing strap members.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, the degree of ground reaction force attenuation, and the energy absorption properties may be altered to meet the specific demands of the activity for which the footwear is intended to be used.

Terminology/General Information

First, some general terminology and information is provided that will assist in understanding various portions of this specification and the invention(s) as described herein. As noted above, the present invention relates to the field of footwear and other foot-receiving devices, including securing systems for such devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures and one or more "foot-supporting members" (e.g., akin to footwear sole structure components), which support at least some portion(s) of a plantar surface of a user's foot. "Securing systems," like those in accordance with at least some aspects of this invention, may help position and/or securely hold the user's foot in place with respect to the foot-covering member(s) and/or the foot-supporting member(s). "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-supporting members" may include components for and/or functioning as midsoles and/or outsoles for articles of footwear (or components providing corresponding functions in non-footwear type foot-receiving devices).

FIG. 1 also provides information that may be useful for explaining and understanding the specification and/or aspects of this invention. More specifically, FIG. 1 provides a representation of a footwear/foot-receiving device component 100, which in this illustrated example constitutes a portion of a sole structure for an article of footwear. The same general definitions and terminology described below may apply to footwear and foot-receiving devices in general and/or to other footwear/foot-receiving device components or portions thereof, such as an upper, a midsole component, an outsole component, etc.

First, as illustrated in FIG. 1, the terms "forward" or "forward direction" as used herein, unless otherwise noted or clear from the context, mean toward or in a direction toward a forward-most toe area of the footwear or foot-receiving device structure or component 100. The terms "rearward" or "rearward direction" as used herein, unless otherwise noted or clear from the context, mean toward or in a direction toward a rear-most heel area of the footwear or foot-receiving device structure or component 100. The terms "lateral" or "lateral side" as used herein, unless otherwise noted or clear from the context, mean the outside or "little toe" side of the footwear or foot-receiving device structure or component 100. The terms "medial" or "medial side" as used herein, unless otherwise noted or clear from the context, mean the inside or "big toe" side of the footwear or foot-receiving device structure or component 100.

Also, various example features and aspects of this invention are disclosed or explained herein with reference to a "longitudinal direction" and/or with respect to a "longitudinal length" of a footwear/foot-receiving device component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight applied to it other than potentially the weight of the shoe/foot-receiving device components with which it is engaged). If the forwardmost and/or rearmost locations of a specific footwear or foot-receiving device component 100 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 further shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

The terms "strap" and "strap portions" as used herein, unless otherwise noted, mean a band of material having: (a) a substantially greater width dimension ("W") than a thickness dimension ("T") and (b) a substantially greater length dimension ("L") than width dimension. As some more specific examples, "straps" or "strap portions" in accordance with at least some examples of this invention will have one or more of: (a) a width dimension to thickness dimension ratio ("W/T") over at least 75% of its longitudinal length of at least 5, (b) an absolute width dimension W of at least 10 mm over at least 75% of its length L, (c) an absolute thickness dimension T of less than 3 mm over at least 75% of its length L, and/or (d) an absolute length dimension L of at least 2.5 times its widest width dimension over that length. A "strap" or "strap portion" may be connected to or integrally formed with another element or component that is not a "strap" or "strap portion."

As some more specific examples, "straps" or "strap portions" in accordance with at least some examples of this invention may have one or more of:

a. a W/T ratio over at least 75% of the strap's length of at least 7.5, at least 10, at least 15, at least 20, or at least 25; in some examples, these W/T ratio ranges will be provided over at least 85%, at least 90%, at least 95%, or even over 100% of the strap's length;
b. a W/T ratio over at least 75% of strap's length in a range of 5 to 50, in a range of 7.5 to 48, or in a range of 10 to 45; in some examples, these W/T ratio ranges will be provided over at least 85%, at least 90%, at least 95%, or even over 100% of the strap's length;
c. an absolute thickness dimension of less than 2.5 mm or less than 2 mm over at least 75% of the strap's length; in some examples, these thickness dimension ranges will be provided over at least 85%, at least 90%, at least 95%, or even over 100% of the strap's length;
d. an absolute width dimension over at least 75% of the strap's length of at least 15 mm or at least 18 mm; in some examples, these width dimension ranges will be provided over at least 85%, at least 90%, at least 95%, or even over 100% of the strap's length;
e. an absolute width dimension over at least 75% of the strap's length within a range from 10 to 75 mm, and in some examples, within a range from 15 to 65 mm or within a range from 18 to 60 mm; in some examples, these absolute strap width dimension ranges will be provided over at least 85%, at least 90%, at least 95%, or even over 100% of the strap's length;
f. an absolute strap length of at least 3 times or at least 5 times the strap's widest width dimension over that length;
g. an absolute width dimension that varies over the strap's length, e.g., tapers, stepwise changes, or otherwise varies in width from wider to narrower or vice versa (e.g., having a width of 40 to 60 mm at locations where engaged with and/or emerging from a sole structure and a width of 15 to 25 mm at its free end); and/or h. an absolute thickness dimension that varies over its length and/or width, e.g., tapers, stepwise changes, or otherwise varies in thickness from thicker to thinner or vice versa).

For determining the W/T ratios as described above, the width and thickness dimensions are measured at a common location on the strap structure. The strap's length dimension L may be measured as the dimension from: (a) a location where one end of the strap is fixed to the upper or sole structure (e.g., where the strap emerges from a location between the upper and the sole structure) and (b) a free end of the strap. The strap's thickness dimension T at a given point is measured as the direct distance (shortest distance) between a first major surface and a second major surface of the strap at that point. The strap's width dimension W at a given point is measured as the direct distance (shortest distance) from one side edge of the strap to its opposite side edge at that point. These measurements are made with the strap or strap portion held taut but not under a substantial tensile force (e.g., less than 0.1 kg tensile force).

While straps or strap portions may be stretchable or unstretchable, in the illustrated examples, the strap portions are unstretchable. The terms "not stretchable" or "unstretchable," as used herein in this context, mean that the strap or strap portion stretches less than 5% of its unloaded longitudinal length under a tensile force of 10 kg.

SUMMARY

This Summary is provided to introduce some concepts relating to this invention in a simplified form that are further described below in the Detailed Description. This Summary is not intended to identify key features or essential features of the invention.

While potentially useful for any desired types or styles of shoes or foot-receiving devices, aspects of this invention may be of particular interest for athletic shoes, including basketball shoes (e.g., high top basketball shoes).

Some aspects of this invention relate to articles of footwear (or other foot-receiving devices) that include:

(A) an upper (or other foot-covering member) defining a foot-insertion opening, a lateral ankle side, a medial ankle side, and an instep area (forward of the foot-insertion opening), wherein the upper includes: (i) a medial strap tensioning component located on the medial ankle side, and (ii) a lateral strap tensioning component located on the lateral ankle side;

(B) a sole structure (or other foot-supporting member) engaged with the upper (or foot-covering member), optionally engaged such that junctions between these elements may be located at a medial edge and/or a lateral edge of the article of footwear/foot-receiving device; and (C) a securing system engaged with the upper/foot-covering member, wherein the securing system includes: (i) a first strap portion extending across the instep area, engaging the lateral strap tensioning component, extending in front of the foot-insertion opening, and extending to the medial ankle side, and (ii) a second strap portion extending across the instep area, engaging the medial strap tensioning component, extending in front of the foot-insertion opening, and extending to the lateral ankle side, wherein the first and second strap portions cross one another at two separated crossing locations (one crossing location located forward of the other crossing location). The upper/foot-covering member further may include a medial strap securing component (e.g., a hook-and-loop fastener or other type of fastener) located on the medial side of the foot-insertion opening (e.g., between the foot-insertion opening and the medial strap tensioning component) for securing the first strap portion and/or a lateral strap securing component (e.g., a hook-and-loop fastener or other type of fastener) located on the lateral side of the foot-insertion opening (e.g., between the foot-insertion opening and the lateral strap tensioning component) for securing the second strap portion.

If desired, the medial strap tensioning component and/or the lateral strap tensioning component may be engaged with a heel reinforcement component, such as a heel counter or other relatively stiff or heavy fabric, textile, or plastic material, that extends around a rear heel area of the upper/foot-covering member. The strap tensioning component(s) may be mounted on straps or other elements that extend from the heel reinforcement component and/or are otherwise mounted to a component of the footwear/foot-receiving device structure.

The first strap portion and the second strap portion may be provided as independent and separate strap components or they may be opposite sides of a single strap member or other component (e.g., a component that extends beneath a plantar support surface between the upper/foot-covering member and the sole structure/foot-supporting member from the lateral side edge to the medial side edge). While other constructions are possible, the first strap portion may be fixedly engaged between the upper/foot-covering member and the sole structure/foot-supporting member at a first strap engagement or emerging location located forward of the first strap crossing location, and the second strap portion may be fixedly engaged between the upper/foot-covering member and the sole structure/foot-supporting member at a second strap engagement or emerging location located forward of the first strap crossing location.

At least some example articles of footwear/foot-receiving devices according to aspects of this invention may include one or more of the following constructions and/or orientations when a bottom surface of the sole structure/foot-supporting member rests on a horizontal surface:

(a) the sole structure/foot-supporting member defines a longitudinal direction and a longitudinal length L from a rearmost heel location to a forwardmost toe location;

(b) a forward edge of the first strap portion meets the sole structure/foot-supporting member at the medial edge of the footwear/foot-receiving device structure at a first location forward of a plane perpendicular to the longitudinal direction and located at a position 0.6L along the longitudinal direction, measured forward from the rearmost heel location (and in some examples, forward of planes at 0.55L, 0.65L, or 0.7L);

(c) a forward edge of the second strap portion meets the sole structure/foot-supporting member at the lateral edge of the footwear/foot-receiving device structure at a second location forward of the plane located at position 0.6L (and in some examples, forward of planes at 0.55L, 0.65L, or 0.7L);

(d) a rear edge of the first strap portion meets the sole structure/foot-supporting member at the medial edge of the footwear/foot-receiving device structure at a first location forward of a plane perpendicular to the longitudinal direction and located at a position 0.55L along the longitudinal direction, measured forward from the rearmost heel location (and in some examples, forward of planes at 0.5L, 0.6L, or 0.65L); and/or (e) a rear edge of the second strap portion meets the sole structure/foot-supporting member at the lateral edge of the footwear/foot-receiving device structure at a second location forward of the plane located at position 0.55L (and in some examples, forward of planes at 0.5L, 0.6L, or 0.65L).

Additionally or alternatively, in some example footwear and foot-receiving device structures in accordance with this invention, the medial strap tensioning component will define a medial turning location for the second strap portion (e.g., a ring, loop, or other structure around which the second strap portion winds or wraps so as to change its extension direction) and the lateral strap tensioning component will define a lateral turning location for the first strap portion (e.g., a ring, loop, or other structure around which the first strap portion winds or wraps so as to change its extension direction). Such footwear and foot-receiving device structures may include one or more of the following constructions and/or orientations when a bottom surface of the sole structure/foot-supporting member rests on a horizontal surface:

(a) the sole structure/foot-supporting member defines a longitudinal direction and a longitudinal length L from a rearmost heel location to a forwardmost toe location;

(b) at least some portion of the medial turning location (and optionally all of the medial turning location) is located rearward of a plane perpendicular to the longitudinal direction and located at a position 0.4L along the longitudinal direction, measured forward from the rearmost heel location (and in some examples, rearward of planes located at 0.45L, 0.35L, or 0.3L);

(c) at least some portion of the lateral turning location (and optionally all of the lateral turning location) is located rearward of the plane located at position 0.4L (and in some examples, rearward of planes located at 0.45L, 0.35L, or 0.3L);

(d) at least some portion of the medial turning location (and optionally all of the medial turning location) is located between two spaced, parallel planes perpendicular to the longitudinal direction and located at positions 0.2L and 0.45L, respectively, along the longitudinal direction, measured forward from the rearmost heel location (and in some examples, between two spaced, parallel planes located at positions 0.25L and 0.4L);

(e) at least some portion of the lateral turning location (and optionally all of the medial turning location) is located between the two spaced, parallel planes at positions 0.2L and 0.45L (and in some examples, between two spaced, parallel planes located at positions 0.25L and 0.4L); and/or (f) the medial and/or lateral strap turning locations may be located somewhat forward and downward from locations of a wearer's medial and/or lateral malleolus protuberances when a wearer's foot is secured in an article of footwear according to aspects of this invention that is properly sized for the wearer's foot.

Additional aspects of this invention relate to methods of making articles of footwear and/or other foot-receiving devices that include: (a) producing the various footwear/foot-receiving device components (e.g., an upper or foot-covering component) with medial and/or lateral strap tensioning components (e.g., located/oriented as described above and in more detail below); (b) engaging a securing system including first and/or second strap portions of the types described above (e.g., and in the orientations described above and in more detail below) with the upper/foot-covering member and/or sole structure/foot-supporting member; (c) producing and/or engaging the various footwear/foot-receiving device components (e.g., an upper or foot-covering component) with medial and/or lateral strap securing components (e.g., located/oriented as described above and in more detail below); and/or (d) joining the upper/foot-covering member(s), securing system, and sole structure/foot-supporting member(s) together so as to form a footwear/foot-receiving device product (optionally fixedly engaging the strap portion(s) between the upper/foot-covering member and the sole structure/foot-supporting member).

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures without departing from the scope of the present invention.

I. DETAILED DESCRIPTION OF EXAMPLE ARTICLES OF FOOTWEAR OR OTHER FOOT-RECEIVING DEVICES ACCORDING TO THIS INVENTION

Referring to the figures and following discussion, various articles of footwear and features thereof in accordance with the present invention are disclosed. The footwear depicted and discussed are athletic shoes (e.g., basketball shoes), but the concepts disclosed with respect to this footwear may be applied to a wide range of athletic footwear styles, including, but not limited to: walking shoes, tennis shoes, soccer shoes, football shoes, basketball shoes, running shoes, and cross-training shoes. In addition, the concepts of the present invention may be applied to a wide range of non-athletic footwear, including work boots, sandals, loafers, and dress shoes, as well as to other foot-receiving devices.

Figure 2A:
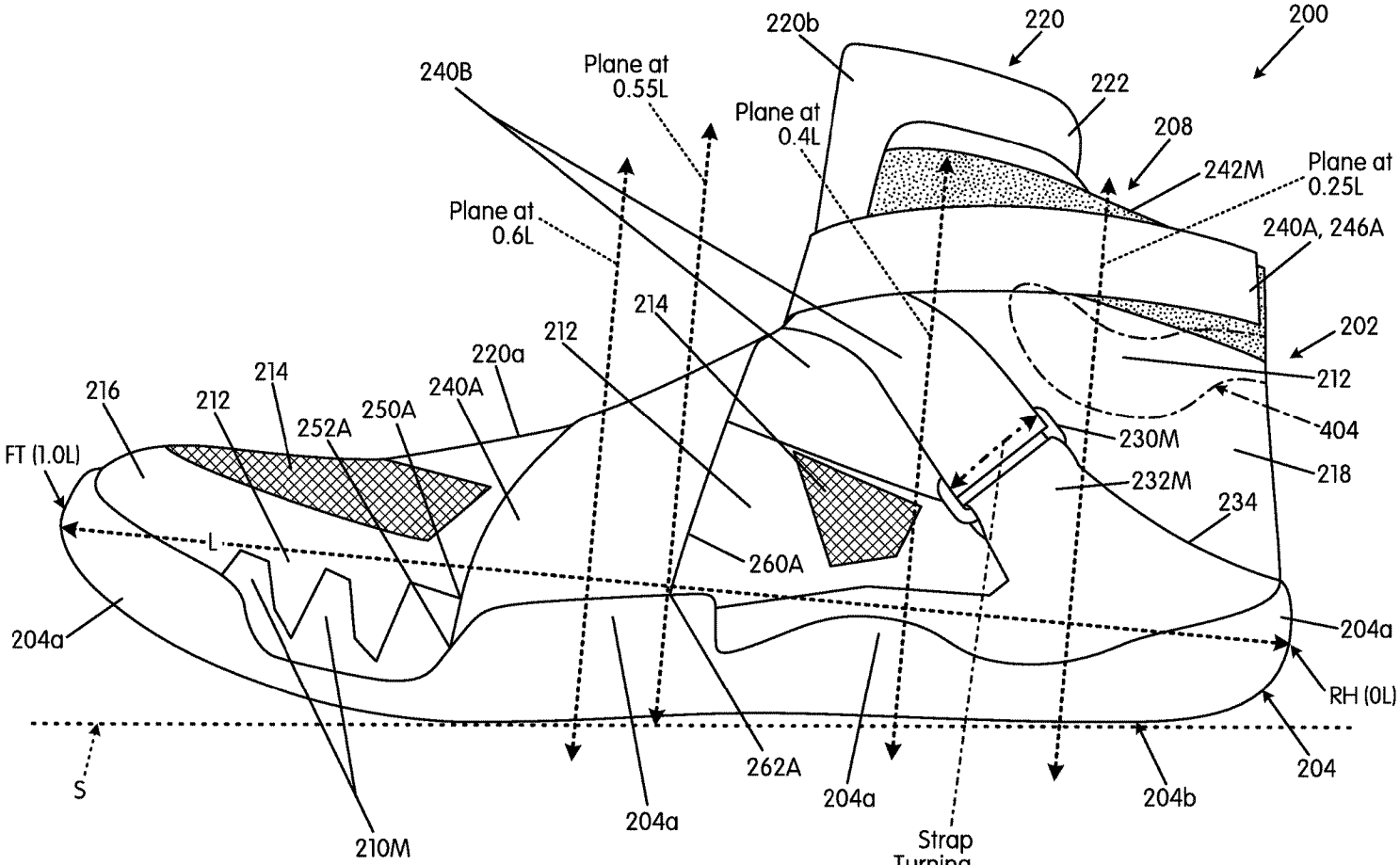
FIGS. 2A through 2E provide various views of an article of footwear in accordance with an example of this invention, including a securing system in accordance with an example of this invention.
Figure 2B:
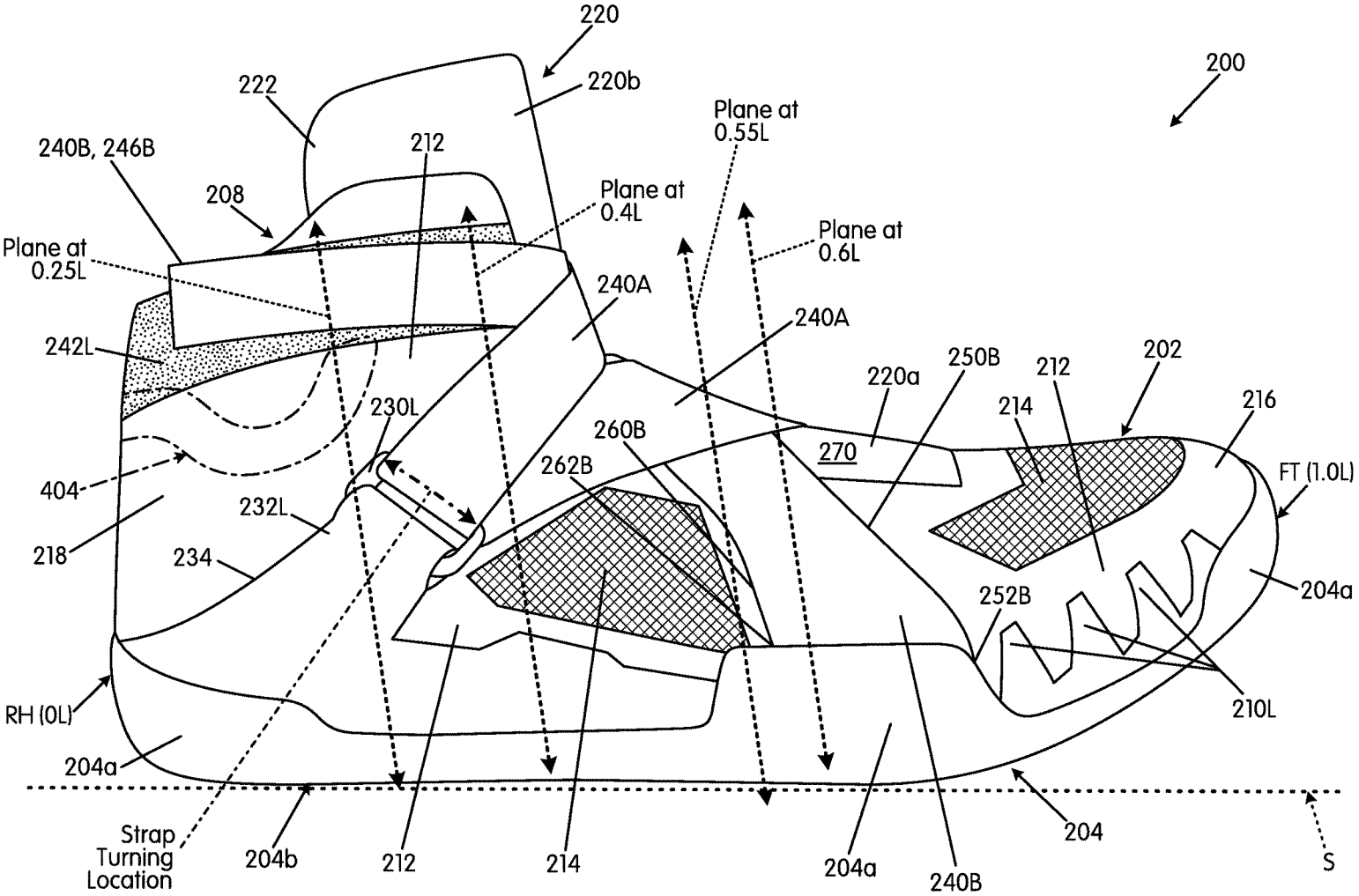
Figure 2C:
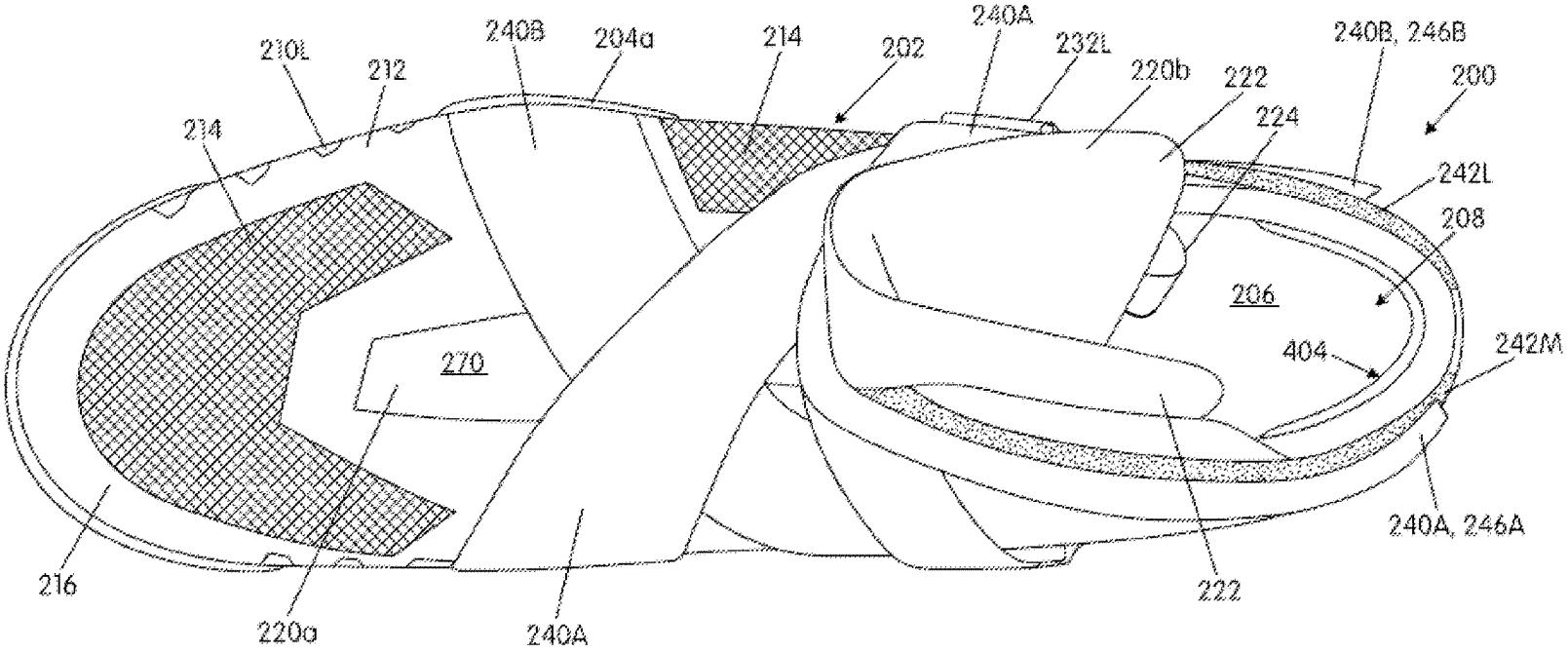
Figure 2D:
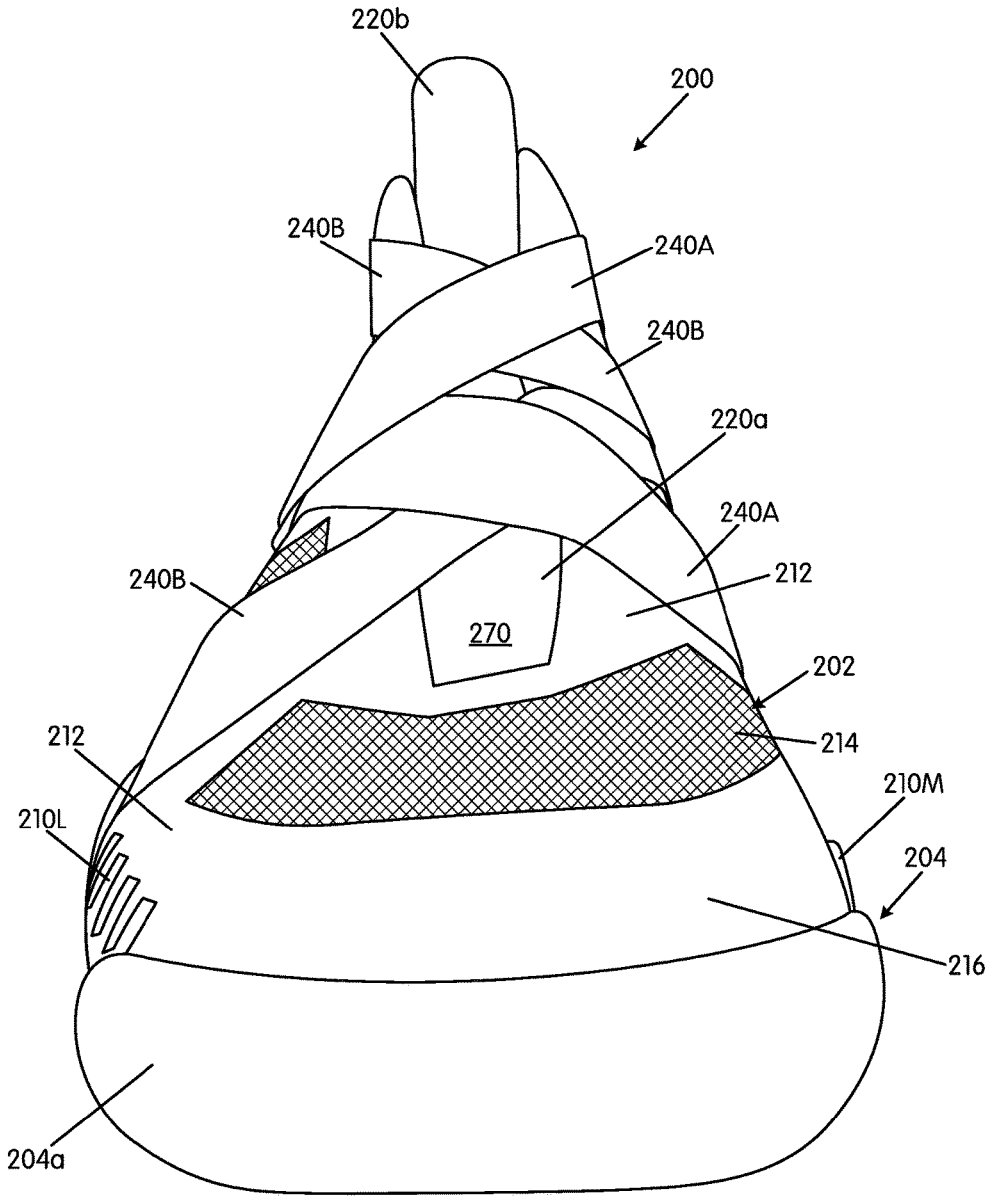
Figure 2E:
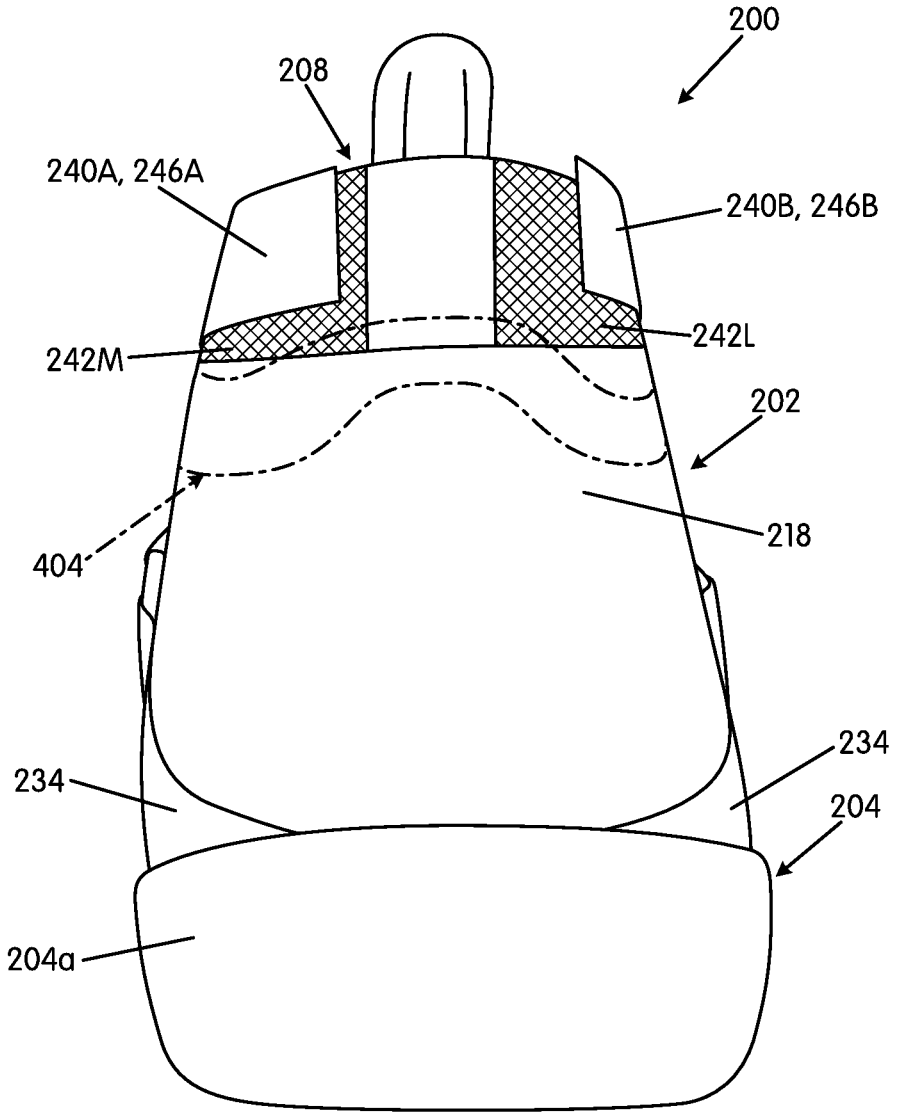

FIGS. 2A-2E show various views of an article of footwear 200 in accordance with one example of this invention in the form of a high top basketball shoe. More specifically, FIG. 2A shows a medial side view, FIG. 2B shows a lateral side view, FIG. 2C shows a top plan view, FIG. 2D shows a front view, and FIG. 2E shows a rear view of this shoe 200. The article of footwear 200 includes an upper 202 and a sole structure 204 engaged with the upper 202. While this engagement may be made in any desired manner, including in manners conventionally known and used in the footwear art, in this illustrated example, the upper 202 and the sole structure 204 are engaged by cements or adhesives. The upper 202 (optionally along with the sole structure 204) defines an interior chamber 206 for receiving a wearer's foot, and access to this chamber 206 may be made through a foot-insertion opening 208 provided at the top, rearward area of the upper 202.

The upper 202 may have any desired construction and/or may be made from any desired number of parts without departing from this invention. In some examples of this invention, the upper 202 will have a multiple layer construction, with various layers and/or combinations of layers at various locations so as to provide desired functions and/or characteristics, such breathability, abrasion/wear resistance, support for intended use, desired aesthetics, etc.

When present as a multi-layered upper construction, the upper 202 may be produced in any desired manner without departing from this invention, including in conventional manners as are known and used in the footwear art. As a more specific example, if desired, the upper 202 may include one or more "skin" layers 212 (e.g., a thin, thermoplastic elastomer sheet or membrane layer that provides abrasion resistance, support, desired aesthetics, etc.) made from a "no-sew" type material that may be adhered to an underlying mesh layer 214 (or other layer) using an adhesive or hot melt material, e.g., by application of heat and/or pressure. The mesh layer 214 provides a lightweight base and may be left exposed in certain areas to enhance breathability and flexibility at desired areas. As additional examples, if desired, the skin layer(s) 212 may be engaged with the underlying mesh layer 214 (or other layer) by cements or adhesives and/or by sewn seams. As yet additional examples, if desired, the upper 202 (or portions thereof) may be constructed by bonding various layers of materials using fusing techniques, e.g., as described in U.S. Pat. No. 8,429,835 and U.S. Pat. No. 8,321,984, each of which is entirely incorporated herein by reference.

The upper 202 may include other support elements at desired locations, optionally sandwiched between an exterior skin layer 212 and the underlying mesh layer 214 and/or other layers of the upper 202. Additionally or alternatively, additional support may be provided as an exterior upper structure as well. For example, as shown in the figures, a heel counter 218 (e.g., to support a wearer's heel) is provided as an exterior component in this example footwear structure 200. The heel counter 218, when present, may be made from a rigid, thin plastic material, such as PEBAX, TPU, fiber reinforced plastics (e.g., carbon fiber or fiberglass), or other polymeric material, and it may include one or more openings (e.g., to control flexibility, breathability, support characteristics; to reduce weight; etc.). As other options, the heel counter 218 also may be made (at least in part) from a heavy textile material (e.g., leather), if desired.

If necessary or desired, still additional supports and/or components may be provided in other areas of the shoe 200, such as in the forefoot or toe area (to provide protection and wear resistance, to provide shape support, etc.), at the lateral side or edge area near the fifth metatarsal head, etc. (e.g., to provide support for turning or cutting actions), at the medial side or edge area near the first metatarsal head, etc. FIGS. 2A and 2B show side edge support members 210M and 210L, respectively, along the medial side edge area (near the first metatarsal head) and the lateral side edge area (near the fifth metatarsal head) to provide additional support for these areas (e.g., when a sideways force is applied to the shoe 200, such as when making a quick start, quick stop, turn, or cutting action). These support members 210M and 210L may include fingers of a stiffer, heavier, or harder upper material formed as one of the upper layers and applied to an exterior skin layer 212 via a hot melt adhesive or fusing technique. These fingers of support material 210M, 210L extend from the sole member 204/upper 202 junction area and along the side edges of the upper 202 to partially enclose and support the side forefoot areas of the shoe 200. The figures further show a toe cap 216 that further helps protect the toes (e.g., to provide a sturdier upper construction at the toe area, to provide shape support at the toe area, etc.).

Other potential materials that may be used in uppers 202 in accordance with at least some examples of this invention (including for components 210L, 210M, 216, 218, etc.) include one or more of: synthetic leather, natural leather, textiles, thermoplastic polyurethanes, any combination of these materials, and/or any combinations of these materials with any of the other materials described above. As another potential feature, if desired, at least some portion(s) of the upper 202 may be formed by a knitting procedure, such as flat knitting, circular knitting, etc. Optionally, at least a majority (or even all) of the upper 202 may be formed using knitting procedures, in at least some examples of this invention. Knitted textile components can be used to provide lightweight, breathable, and comfortable upper constructions.

The sole structure 204 also can take on any desired construction, components, and the like without departing from this invention. In the illustrated example, the sole structure 204 includes a single piece outsole 204*a* with a herringbone tread pattern that extends continuously to support an entire plantar surface of a wearer's foot. Portions of the outsole 204*a* wrap up around the side of the footwear structure 200 at some locations, e.g., to provide additional support, wear resistance, and/or other properties at those locations. More specifically, as shown in the figures, the outsole 204*a* of this example wraps upward and around the side of the shoe 200 in the forward toe area, at the lateral midfoot/forefoot area (behind upper lateral supports 210L), around the entire the heel area (or, optionally, around one or more separated portions of the heel area), at the arch area, and at the medial midfoot/forefoot area (behind upper medial supports 210M). The outsole 204*a* may wrap around the side edges of the footwear structure 200 at locations where the securing strap components are located and secured, as will be described in more detail below.

Also, while the outsole 204*a* is the only sole structure visible in this example shoe 200 construction, the shoe 200 may include other sole components, as well, such as midsole and/or insole components. A midsole provided in this shoe 200 may have the form of a polymeric foam material, e.g., located between the outsole structure 204*a* and a bottom surface (e.g., a strobel member) of the upper 202, located within the foot-receiving chamber 206 of the upper 202, etc. Other sole structure options are possible without departing from this invention, such as one or more of: one or more impact-force attenuating columns (akin to SHOX type footwear products available from NIKE, Inc. of Beaverton, Oreg.); one or more fluid-filled bladders (akin to AIR type footwear products available from NIKE, Inc. of Beaverton, Oreg.); one or more lugs and/or sipes (e.g., to provide more natural motion, akin to sole structures used in FREE type footwear products available from NIKE, Inc. of Beaverton, Oreg.); mechanical shock absorbing structures; etc.

FIGS. 2A-2D further illustrate that the article of footwear 200 of this example includes a closure member 220 over at least the instep area. The closure member 220 of this example constitutes a footwear "tongue" like element that includes a fabric component 220*a* (optionally a stretchable fabric) extending over and closing off the instep area and a soft free end 220*b* located near the foot-insertion opening 208. The closure member 220 helps moderate the feel of the footwear securing system at the wearer's foot, which will be described in more detail below.

While a more conventional tongue structure and lacing system could be included in this article of footwear 200, in this illustrated example, the fabric instep covering component 220*a* of the closure member 220 is fixed to other portions of the upper 202 along the instep area (e.g., by stitching or sewn seams), e.g., up to the location of the soft free end 220*b* and/or its attachment to the upper 202. Instep covering component 220*a* may provide sufficient stretchability to accommodate insertion and removal of the foot from the foot-receiving chamber 206. The rear edges 222 of the soft free end 220*b* of the closure member 220 are fixed to the upper 202 inside the foot-insertion opening 208 via a pair of elastic straps 224 (one strap 224 on the lateral side and one strap 224 on the medial side, each strap 224 being less than about 1 inch wide). The elastic straps 224 help keep the closure member 220 correctly positioned with respect to the foot and readily accessible to the wearer (e.g., so the free end 220*b* does not slip down into the foot-receiving chamber 206), while providing adequate stretchability (via elastic straps 224) to allow insertion and removal of the foot from chamber 206.

Additional aspects of the illustrated example footwear securing system now will be described in more detail, additionally with reference to FIGS. 2F through 2H. As illustrated, in this example footwear 200 structure, the upper 202 includes a medial strap tensioning component 230M located on the medial ankle side and a lateral strap tensioning component 230L located on the lateral ankle side of the shoe 200. The tensioning components 230L and 230M in this example are mounted on straps 232L and 232M, respectively, that extend from an exterior footwear support member 234. While the illustrated straps 232L and 232M are provided as parts of a single support member 234 that extends around the rear heel of the shoe 200, this is not a requirement. Rather, if desired, the tensioning components 230L, 230M may be mounted on straps 232L, 232M provided on separate support components 234 and/or may be otherwise mounted on portions of the footwear structure 200.

While other structures are possible, in this illustrated example, the exterior footwear support member 234 constitutes a relatively heavy leather (natural or synthetic) or textile component (e.g., a thermoplastic polyurethane) or a plastic component that extends around the rear heel area outside of the heel counter element 218 and functions as a heel reinforcement element. Optionally, however, if desired, the support member 234 also may constitute a heel counter type element and/or it may be integrally formed with a heel counter element 218. Also, while not a requirement, in this illustrated example, the support member 234 extends forward along the side edges of the footwear structure 200 and forms the lateral and medial supports 210L and 210M, respectively. The support member 234 may be engaged with other portions of the upper 202 construction (e.g., skin layer 212, mesh layer 214, heel counter 218, etc.) in any desired manner, including in manners conventionally known and used in the art, such as one or more of: sewing or stitching; adhesive, cements, or hot melt; mechanical connectors; etc.

The tensioning components 230L, 230M may have any desired construction or structure without departing from the invention. In this illustrated example, the tensioning components 230L, 230M constitute structures that engage a strap for a securing system and structures against which a strap may apply a force to tighten the securing system (and thus tighten the fit of the shoe 200 on a wearer's foot). The illustrated tensioning components 230L, 230M are loops or ring shaped elements (e.g., D-rings, O-rings, C-rings, etc.) that, optionally together with the strap 232L, 232M, form an enclosure through which the strap is threaded, as will be described in more detail below. The tensioning components 230L, 230M provide a turning location for the strap, as will be described in more detail below.

The securing system of this illustrated example further includes two strap portions 240A and 240B that at least partially wrap around and engage upper 202 and the wearer's foot. The strap portions 240A and 240B may constitute separate straps or they may constitute opposite ends of a single strap or other component (e.g., a strap or other component that extends beneath the plantar support surface from the medial side edge to the lateral side edge of the shoe 200). As shown, in this illustrated example shoe structure 200, a first strap portion 240A: (a) emerges from its engagement location between the sole member 204 and the upper 202 at the medial midfoot/forefoot area of the shoe 200, (b) extends across the instep area, and (c) engages the lateral strap tensioning component 230L, at which location the extension direction of the first strap portion 240A abruptly turns. After wrapping around the lateral strap tensioning component 230L, the first strap portion 240A extends in front of the foot-insertion opening 208 and around to the medial ankle side of the upper 202. A medial strap securing component 242M may be provided on the medial ankle side of the upper (e.g., located on the medial side of the foot-insertion opening 208) for securing a free end 246A of the first strap portion 240A. This securing connection between the free end 246A of the first strap portion 240A and the medial strap securing component 242M may be a hook-and-loop fastener type connection, a buckle type connection, a snap type connection, a button type connection, etc. The medial strap securing component 242M may be located in the vertical direction (with the shoe 200 standing on its sole 204 on a horizontal surface S) between the foot-insertion opening 208 and the medial strap tensioning component 232M, in at least some example structures according to this invention.

In a similar manner, in this illustrated example shoe structure 200, a second strap portion 240B: (a) emerges from its engagement location between the sole member 204 and the upper 202 at the lateral midfoot/forefoot area of the shoe 200, (b) extends across the instep area, and (c) engages the medial strap tensioning component 230M, at which location the extension direction of the second strap portion 240B abruptly turns. After wrapping around the medial strap tensioning component 230M, the second strap portion 240B extends in front of the foot-insertion opening 208 and around to the lateral ankle side of the upper 202. A lateral strap securing component 242L may be provided on the lateral ankle side of the upper (e.g., located on the lateral side of the foot-insertion opening 208) for securing a free end 246B of the second strap portion 240B. This securing connection between the free end 246B of the second strap portion 240B and the lateral strap securing component 242L may be a hook-and-loop fastener type connection, a buckle type connection, a snap type connection, a button type connection, etc. The lateral strap securing component 242L may be located in the vertical direction between the foot-insertion opening 208 and the lateral strap tensioning component 232L, in at least some example structures according to this invention. As shown in the figures, in this illustrated structure, when fully engaged, the first strap portion 240A and the second strap portion 240B cross one another two times at two separated crossing locations (e.g., once in the instep area 270 of the upper 202 and once again rearward (and upward) from the first, instep area location and near the foot-insertion opening). The two strap portions 240A, 240B may cross over one another in any desired stacking layer order without departing from the invention (e.g., either strap 240A, 240B may be on top at either crossing location).

Footwear 200 and their securing system structures in accordance with at least some examples of this invention may have at least some of the properties described below. For example, as illustrated in FIGS. 2A and 2C, the first strap portion 240A may be fixedly engaged between the upper 202 and the sole structure 204 and emerge from between these components at a first strap engagement location located along the medial side edge of the shoe 200. While it could be provided at any desired location on the article of footwear structure 200, this first strap portion 240A emerging/engagement location may be located forward of the first strap crossing location. Similarly, as illustrated in FIGS. 2B and 2C, the second strap portion 240B may be fixedly engaged between the upper 202 and the sole structure 204 and emerge from between these components at a second strap engagement location located along the lateral side edge of the shoe 200. While it also could be provided at any desired location on the article of footwear structure 200, this second strap portion 240B emerging/engagement location also may be located forward of the first strap crossing location. While the first and second strap emerging/engagement locations may be at the same longitudinal positions, the medial longitudinal emerging/engagement location for the first strap portion 240A may be somewhat rearward of the lateral longitudinal emerging/engagement location for the second strap portion 240B.

Figure 1:
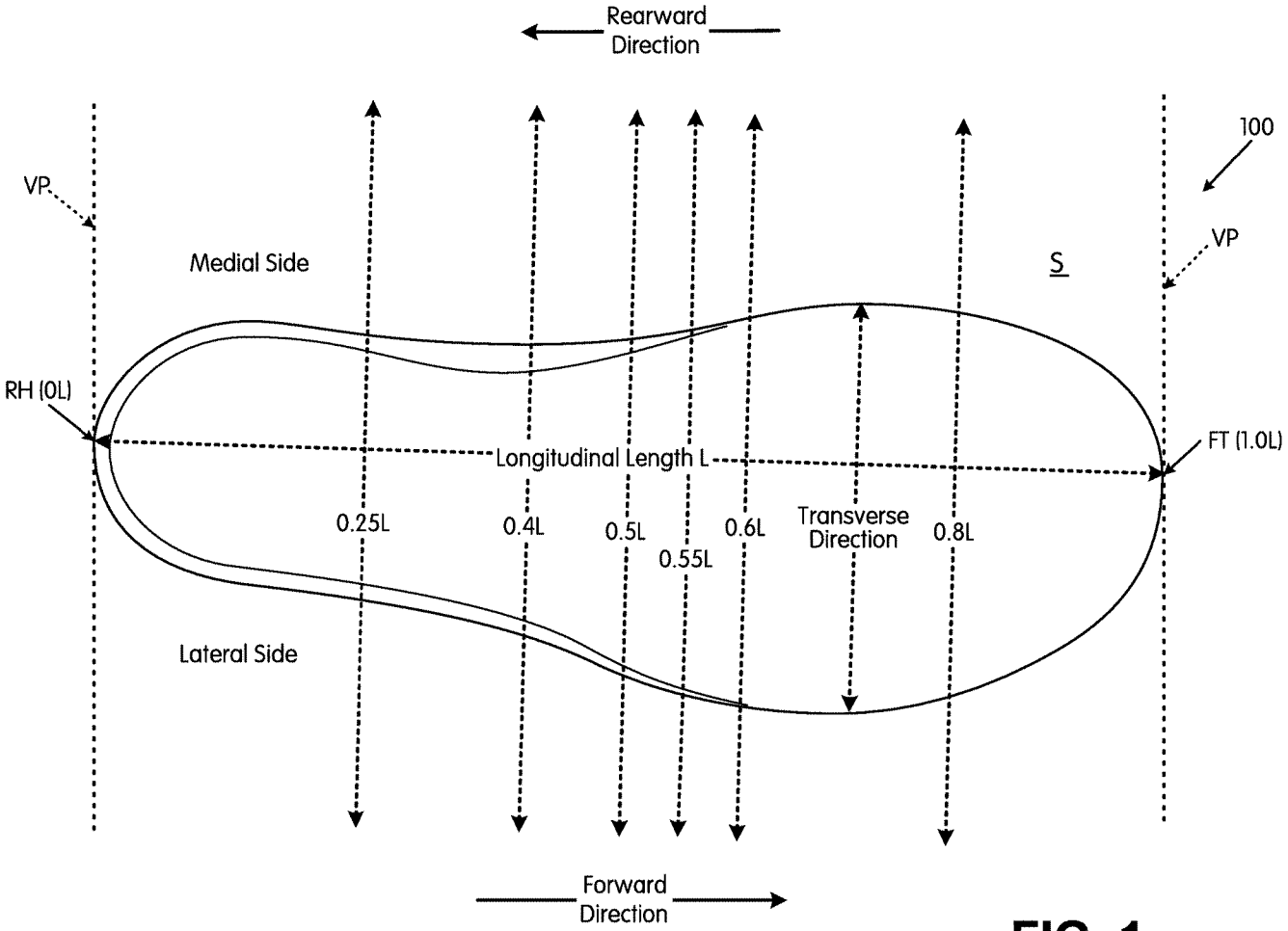
FIG. 1 is provided to help illustrate and explain background and definitional information useful for understanding certain terminology and aspects of this invention.

Other features and characteristics of at least some example footwear/foot-receiving device structures 200 according to this invention may be described with reference to a predetermined orientation of the article of footwear/foot-receiving device 200 or component thereof as described above with respect to FIG. 1, e.g., in an orientation in which a bottom surface 204*b* of the sole structure 204 rests on a horizontal surface S. In this orientation, the sole structure 204 defines a longitudinal direction and a longitudinal length L from a rearmost heel RH location to a forwardmost toe FT location. In this orientation, as shown in FIG. 2A, a forward edge 250A of the first strap portion 240A may meet (or emerge from) the sole structure 204 at the medial side of the upper 202 at a location 252A forward of a plane perpendicular to the longitudinal direction and located at a position 0.6L along the longitudinal direction (measured forward from the rearmost heel RH location). Additionally or alternatively, if desired, in this orientation, as shown in FIG. 2B, a forward edge 250B of the second strap portion 240B may meet (or emerge from) the sole structure 204 at the lateral side of the upper 202 at a location 252B forward of a plane perpendicular to the longitudinal direction and located at a position 0.6L along the longitudinal direction (measured forward from the rearmost heel RH location). In some example structures in accordance with this invention, the forward edge(s) 250A and/or 250B of strap portions 240A, 240B, respectively, may meet (or emerge from) the sole structure 204 at their respective medial or lateral sides of the upper 202 forward of planes perpendicular to the longitudinal direction and located at: (a) positions 0.55L forward from the rearmost heel RH location, (b) positions 0.65L forward from the rearmost heel RH location, (c) positions 0.7L forward of the rearmost heel RH location, (d) positions 0.75L forward of the rearmost heel RH location, and/or (e) positions 0.8L forward of the rearmost heel RH location. In some examples, the forward edge(s) 250A and/or 250B may meet (or emerge from) the sole structure 204 at their respective medial or lateral sides of the upper 202 between two spaced, parallel planes perpendicular to the longitudinal direction and located at: (a) positions 0.55L and 0.85L forward from the rearmost heel RH location and/or (b) positions 0.6L and 0.8L forward from the rearmost heel RH location.

As another example feature in accordance with some aspects of this invention, with the article of footwear 200 oriented on a horizontal surface S in the manner described above: (a) a rear edge 260A of the first strap portion 240A may meet (or emerge from) the sole structure 204 at the medial side of the upper 202 at a location 262A forward of a plane perpendicular to the longitudinal direction and located at a position 0.55L along the longitudinal direction (measured forward from the rearmost heel RH location), and/or (b) a rear edge 260B of the second strap portion 240B may meet (or emerge from) the sole structure 204 at the lateral side of the upper 202 at a second location forward of the plane located at position 0.55L. In some example structures in accordance with this invention, the rear edge(s) 260A and/or 260B of strap portions 240A, 240B, respectively, may meet (or emerge from) the sole structure 204 at their respective medial or lateral sides of the upper 202 forward of planes perpendicular to the longitudinal direction and located at: (a) positions 0.5L forward from the rearmost heel RH location, (b) positions 0.6L forward from the rearmost heel RH location, (c) positions 0.65L forward of the rearmost heel RH location, (d) positions 0.7L forward of the rearmost heel RH location, and/or (e) positions 0.75L forward of the rearmost heel RH location. In some examples, the rear edge(s) 260A and/or 260B may meet (or emerge from) the sole structure 204 at their respective medial or lateral sides of the upper 202 between two spaced, parallel planes perpendicular to the longitudinal direction and located at: (a) positions 0.5L and 0.75L forward from the rearmost heel RH location and/or (b) positions 0.55L and 0.7L forward from the rearmost heel RH location.

As another example feature, if desired, the entire width of the strap portions 240A and 240B (i.e., both the forward edges 250A, 250B and the rear edges 260A, 260B) may be located at any of the longitudinal positions and/or within any of the longitudinal positional ranges (e.g., with respect to the planes perpendicular to the longitudinal direction) described above for forward edges 250A, 250B and/or for the rear edges 260A, 260B. Additionally or alternatively, rather than emerging from and/or being fixed between the upper 202 and the sole structure 204 at the noted longitudinal positions, the strap portions 240A and/or 240B may be fixedly engaged with the upper 202 and/or sole structure 204 at any of the above-noted longitudinal positions and/or within any of the above-noted longitudinal positional ranges, e.g., along the side or edge of the upper 202 and/or sole structure 204. This fixed engagement may be accomplished, for example, by sewing or stitching; by mechanical connectors; by adhesives, cements, or fusing techniques; and/or by other desired means.

The width W of the strap portion 240A at the location where it emerges from the medial side of the sole (e.g., the direct dimension between forward edge 250A and rear edge 260A just above the sole member 204*a* on the medial side) may be about 40 mm in this illustrated example structure (or in some example structures, about 55 mm). Likewise, the width W of the strap portion 240B at the location where it emerges from the lateral side of the sole (e.g., the direct dimension between forward edge 250B and rear edge 260B just above the sole member 204*a* on the lateral side) may be about 40 mm in the illustrated example structure (or in some example structures, about 55 mm). At the lateral and medial side strap turning locations (described in more detail below, e.g., at tensioning components 230L, 230M), the width W of straps 240A and/or 240B may be about 25 mm in this illustrated example structure (or in some example structures, about 30 or 35 mm). At their free ends 246A and 246B, straps 240A and/or 240B may be about 20 mm wide (or in some examples about 25 mm). The strap width dimensions may taper over at least some portion of its length, change at a constant or varying rate over at least some portion of its length, change in a stepwise manner, etc., without departing from this invention.

Additional features and aspects of at least some examples of this invention may relate to the longitudinal positioning of the tensioning components 230L, 230M (and thus the locations at which the strap portions 240A, 240B abruptly turn associated with these example tensioning components 230L, 230M (also called "turning locations" herein)). The "turning locations" in this illustrated example are the locations on the tensioning components 230L, 230M around which the strap portions 240A, 240B partially wrap to change direction (and about which force is applied to the tensioning components 230L, 230M when the strap portions 240A, 240B are pulled to tighten them). As described above in conjunction with FIG. 1, the following features are determined when a bottom surface 204*b* of the sole structure 204 rests on a horizontal surface S and the sole structure 204 defines a longitudinal direction and a longitudinal length L from a rearmost heel RH location to a forwardmost toe FT location. In this orientation, as also shown in FIG. 2A, at least some portion (and optionally all) of the medial turning location (about tensioning component 230M) is located rearward of a plane perpendicular to the longitudinal direction and located at a position 0.4L along the longitudinal direction, measured forward from the rearmost heel location RH. Additionally or alternatively, at least some portion of the lateral turning location (about tensioning component 230L) is located rearward of the plane located at position 0.4L. In some examples of this invention, all or at least some portion(s) of the medial and/or lateral turning locations may be located at positions rearward of planes perpendicular to the longitudinal direction and located at longitudinal positions 0.45L, 0.35L, or even 0.3L. In some structures in accordance with this invention, some or all of the lateral and/or medial turning locations will be located between two spaced, parallel planes perpendicular to the longitudinal direction and located at longitudinal positions 0.2L and 0.45L, and in some examples, between two spaced, parallel planes perpendicular to the longitudinal direction and located at longitudinal positions 0.25L and 0.4L. The strap "turning locations" may be considered as bounded by the portions of the longitudinal width of the strap portions 240A, 240B wrapped around the tensioning members 230L, 230M, as shown in FIGS. 2A and 2B. Tension applied to the tensioning components 230L, 230M by the tightened strap portions 240A, 240B applies a pulling force to straps 232L, 232M and the support member 234 (which wraps around the heel area in this example) to thereby apply a tightening force to the shoe 200.

While they may be provided at other locations, the "turning locations" and the tensioning members 230L and 230M that provide them in this illustrated example are located somewhat forward and downward from a location of a wearer's medial and/or lateral malleolus protuberances (i.e., the boney protrusions at the ankles) when a wearer's foot is secured in an article of footwear 200 that is properly sized for the wearer's foot. This arrangement and orientation of the tensioning members 230L and 230M can provide a more comfortable fit and feel (e.g., the straps and/or tensioning members 230L, 230M will not put pressure on the malleolus protuberances) when the straps are tightened, as will be described in more detail below.

Securing the footwear securing system now will be described in more detail with reference again to FIGS. 2F to 2H. FIG. 2F shows the securing system fully unsecured or disengaged, with the strap portions 240A and 240B fixedly engaged at midfoot/forefoot side locations by being glued between the sole structure 204 and the upper 202 and/or otherwise fixed to the sole structure 204 and/or upper 202 (e.g., by stitching or sewing, by mechanical connectors, etc.). As noted above, the strap portions 240A and 240B may constitute two independent strap elements, opposite sides of a single strap element (e.g., that extends between the sole structure 204 and the upper 202 under the plantar support surface of the shoe 200), and/or portions of another footwear component. When fixed, this engagement will be sufficiently strong so as to allow a user to apply necessary force to the strap portions 240A, 240B to tighten the securing system with the upper 202 and foot without pulling the strap portions 240A, 240B away from their connection/emerging locations.

Figure 2F:
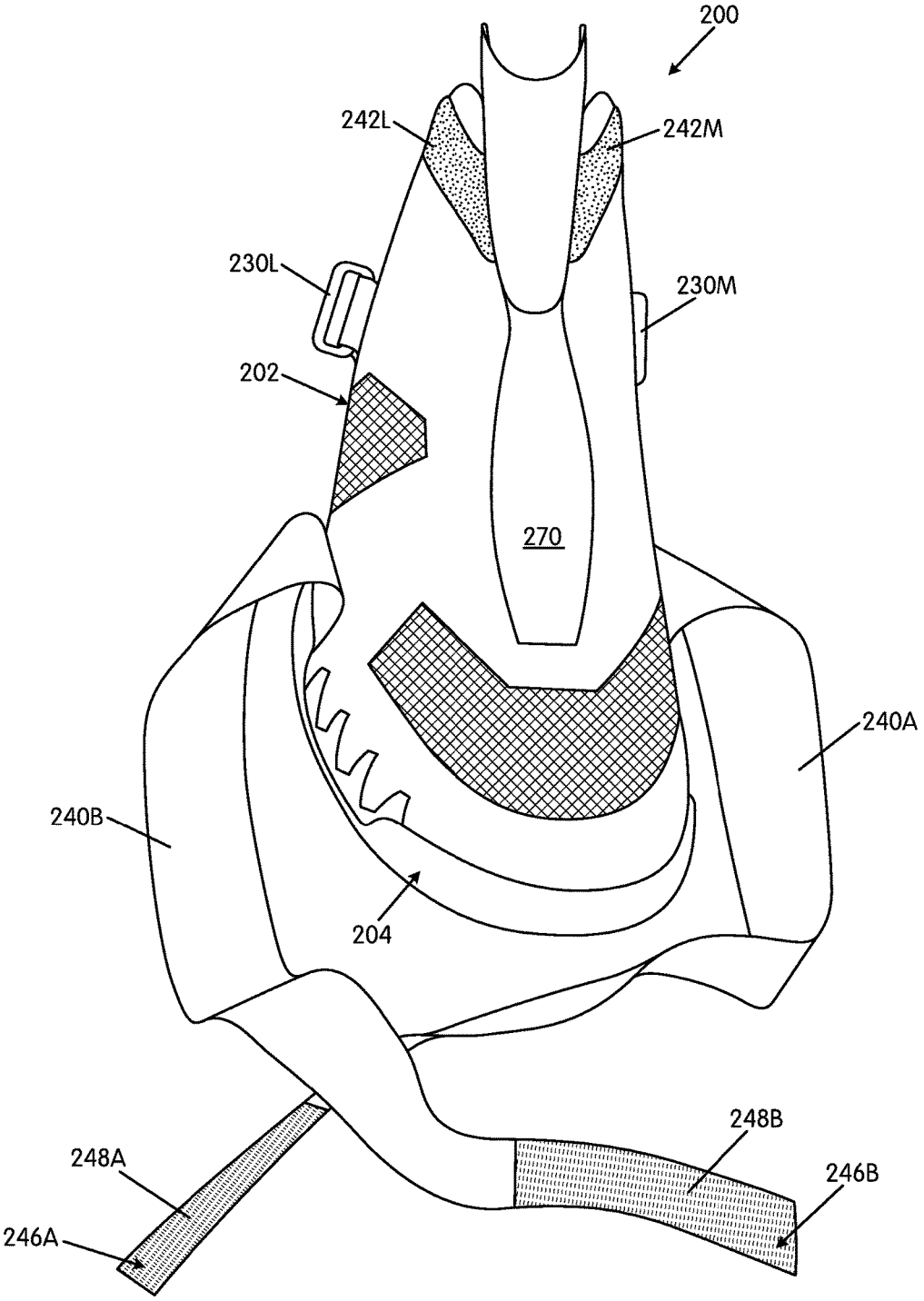
FIGS. 2F through 2H provide various views showing use and operation of the example securing system shown in FIGS. 2A through 2E.
Figure 2G:
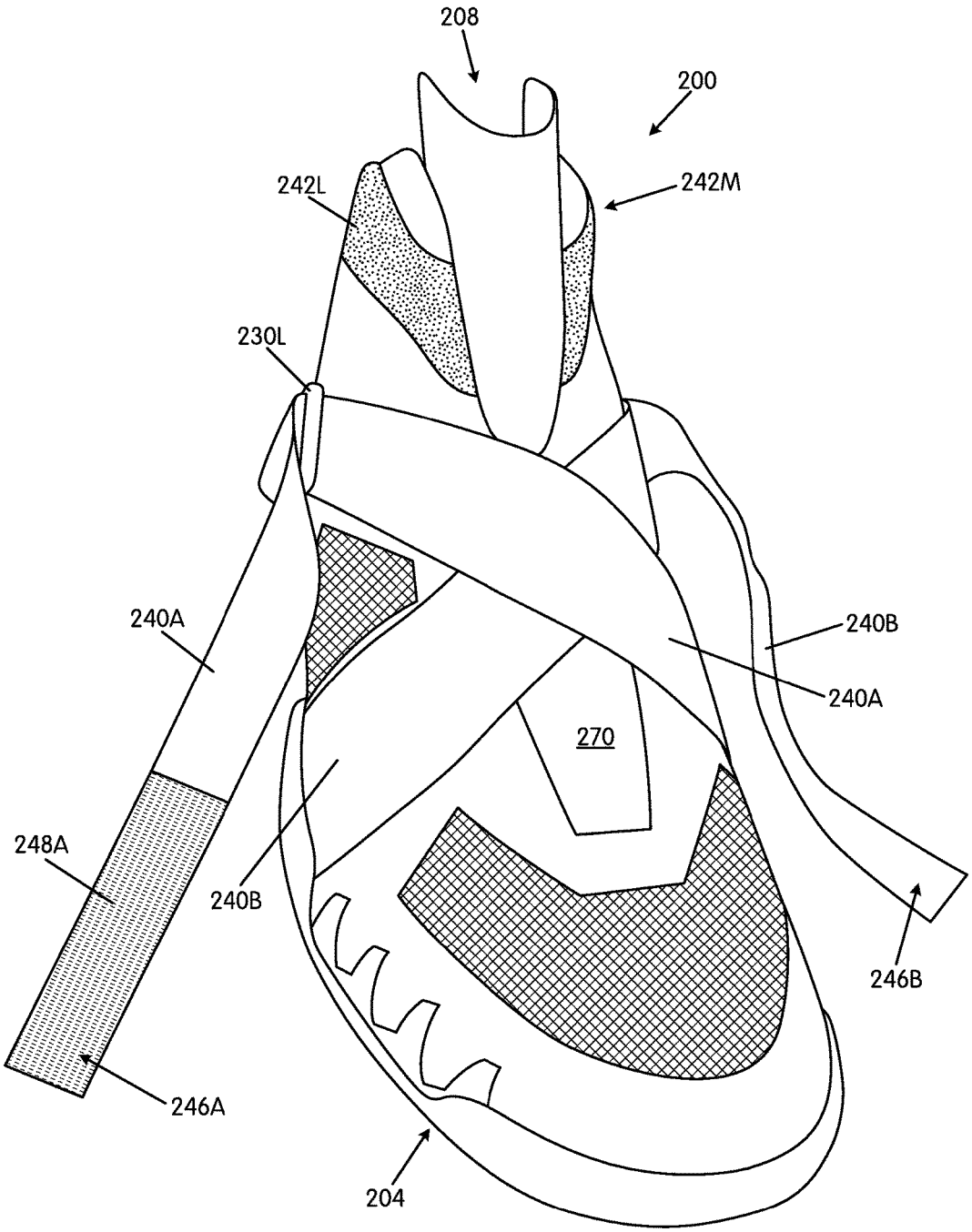
Figure 2H:
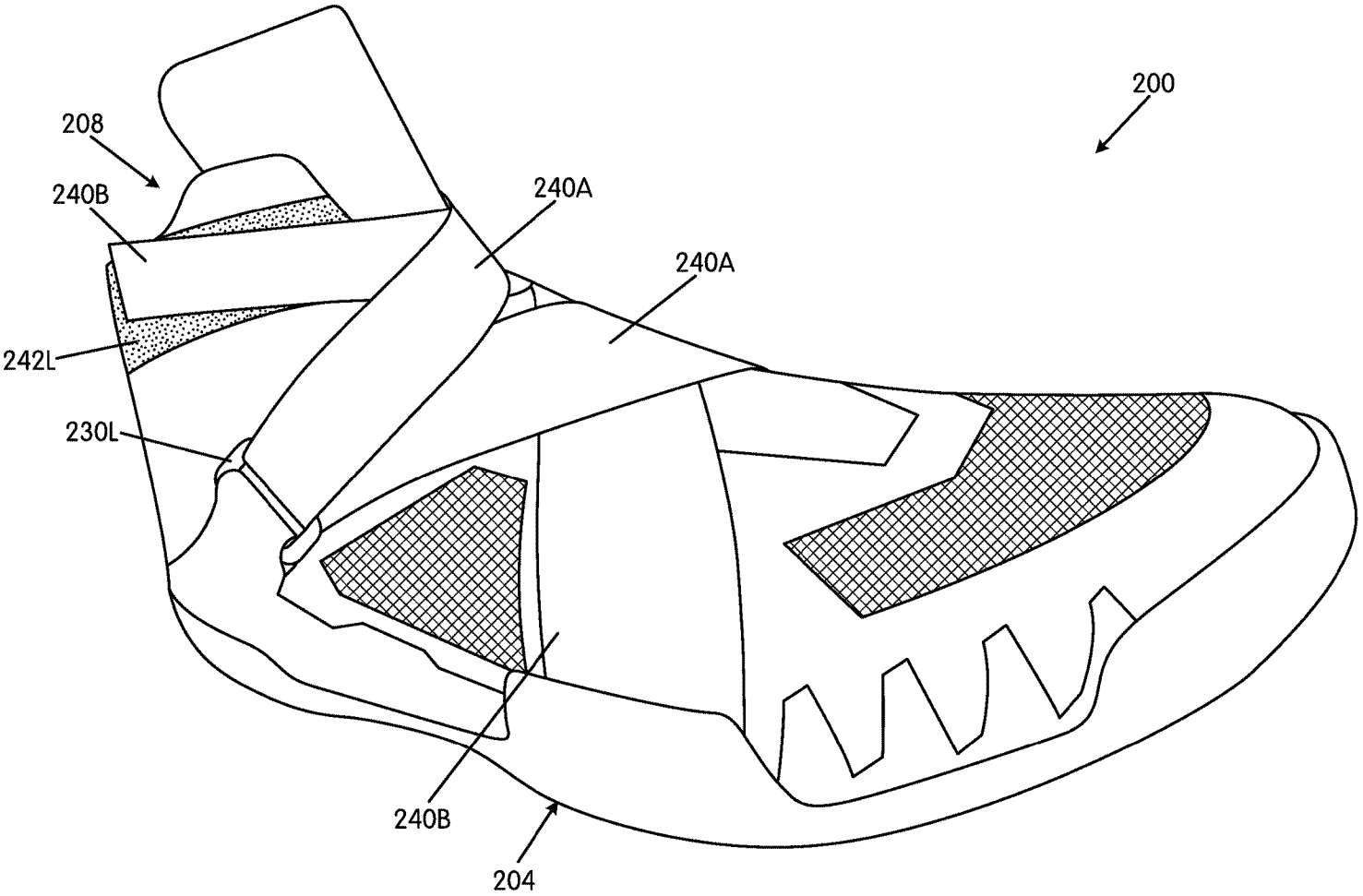

From the disengagement arrangement shown in FIG. 2F, the second strap portion 240B is extended across the instep area 270 of the shoe 200 and the free end 246B thereof is engaged with the medial strap tensioning component 230M (e.g., the free end 246B of the strap portion 240B is threaded through the ring member of tensioning component 230M so that the strap portion 240B abruptly turns back around the ring member). Similarly, the first strap portion 240A is extended across the instep area 270 of the shoe 200 and the free end 246A thereof is engaged with the lateral strap tensioning component 230L (e.g., the free end 246A of the strap portion 240A is threaded through the ring member of tensioning component 230L so that the strap portion 240A abruptly turns back around the ring member). At this stage, this example securing system may have the appearance shown in FIG. 2G, with the two strap portions 240A, 240B crossing one another at the instep area 270. The strap portions 240A, 240B may be extended across the instep area 270 in any desired order (e.g., with either 240A or 240B on top).

The tensioning components 230L and 230M allow the free ends 246A, 246B of the strap portions 240A, 240B to be pulled to securely engage the shoe 200 with a wearer's foot. As one step, the free end 246B of strap portion 240B is pulled tight around tensioning component 230M and stretched around and in front of the foot-insertion opening 208 (in front of the tongue portion 220*b*). From there, the strap portion 240B further extends along the lateral side of the foot-insertion opening 208 to a securing component 242L provided on the upper 202 (and/or optionally on the sole structure 204). Some area of the strap portion 240B (e.g., its free end 246B) may include a corresponding securing component 248B for engaging the securing component 242L. Similarly (and optionally at the same time), the free end 246A of strap portion 240A is pulled tight around tensioning component 230L and stretched around and in front of the foot-insertion opening 208 (in front of the tongue portion 220*b*). From there, the strap portion 240A further extends along the medial side of the foot-insertion opening 208 to a securing component 242M provided on the upper 202 (and/or optionally on the sole structure 204). Some area of the strap portion 240A (e.g., its free end 246A) may include a corresponding securing component 248A for engaging the securing component 242M. As shown in FIG. 2H, in this arrangement, the two strap portions 240A, 240B cross one another a second time at a second, separate crossing location (e.g., at the instep area 270, rearward and/or higher than the first crossing location, adjacent the top portion 220*b* of the tongue member, etc.). The strap portions 240A, 240B may be stretched across the front of the foot-insertion opening 208 in any desired order (e.g., with either 240A or 240B on top), and this stacking order may be the same as or different from the stacking order at the other crossing location.

The two illustrated crossing locations may constitute the only strap crossing locations for strap portions 240A, 240B in some example footwear structures 200 according to the invention (and these two crossing locations may constitute the only strap crossing locations in the entire shoe structure 200). Also, if desired, the strap portions 240A, 240B may change in width over the course of their length (e.g., in a tapered or stepped manner). Optionally, a wider strap portion width may be provided nearer to the engagement/emerging location(s) at the midfoot/forefoot area of the shoe 200 as compared to a narrower strap portion width that may be provided in the area(s) through tensioning members 230L, 230M and/or near/at the free ends 246A, 246B. The two strap portions 240A, 240B may constitute the only straps and/or the only footwear securing components forward of the 0.4L plane for securing the shoe 200 to a foot, optionally without the presence of a conventional footwear lace type securing system. In some examples of this invention, the width of a strap portion may vary such that the widths at the emerging locations ("$W_E$"), the widths at the turning locations ("$W_T$"), and the widths at the free ends ("$W_F$") follow one or more of the following relationships:

$$W_T=0.3W_E \text{ to } 0.7W_E$$

$$W_F=0.2W_E \text{ to } 0.6W_E$$

$$W_F=0.5W_T \text{ to } 1.0W_T$$

$$W_F=0.5W_T \text{ to } 0.8W_T$$

The securing components 242L, 242M, 248A, and 248B may be any desired type of securing component structure, such as a hook-and-loop type fastener system, a buckle type fastener, a button type fastener, a snap type fastener, etc. Alternatively or additionally, if desired, the free ends 246A and 246B of the strap portions 240A and 240B may be engaged together, e.g., by tying, snaps, buttons, buckles, etc. The free ends 246A, 246B also could be engaged with a mechanical component, such as a take up reel or other device around which excess strap (e.g., 240A, 240B) may be wound for storage.

In at least some examples of this invention, including the example shown in FIGS. 2A through 2H, the shoe does not include conventional footwear shoelaces and/or eyelets. Rather, the straps 240A, 240B, the tensioning members 230L, 230M, and the strap securing systems (e.g., the hook-and-loop fastener, etc.) may be the main or only manner of securing the article of footwear 200 to the wearer's foot (and/or tightening the shoe to the wearer's foot). Thus, the main components for tightening the shoe to the wearer's foot in at least some example structures in accordance with this invention may consist essentially of: (a) two straps (e.g., 240A, 240B), (b) two tensioning components (e.g., 230L, 230M), and (c) a securing system for securing the straps 240A, 240B with the upper 202 and/or other footwear component (e.g., hook-and-loop fasteners, etc.). Eliminating the conventional lace system along with instep area (e.g., as with conventional shoes) may allow the front forefoot area of shoe 200 to be free of laces and/or straps, which can allow the wearer's forefoot and/or toes to move somewhat more freely (e.g., splay out when landing a step or jump, etc.) and thereby improve the overall comfort of the shoe 200 for the wearer.

Alternatively, if desired, shoe structures in accordance with some examples of this invention may include a conventional lacing system (e.g., including a more conventional tongue (e.g., one not sewn shut and fixed to the upper along the instep area), a conventional shoe lace, and conventional eyelets or other lace engaging structures), e.g., located beneath the strap portions 240A, 240B. The inclusion of the additional and more conventional lace features may be useful to provide shoe models that allow the instep area to be opened wider for insertion of the foot (e.g., as compared to the more sewn up, fixed, and closed off tongue and instep area shown in the embodiment of FIGS. 2A-2H).

Figure 3A:
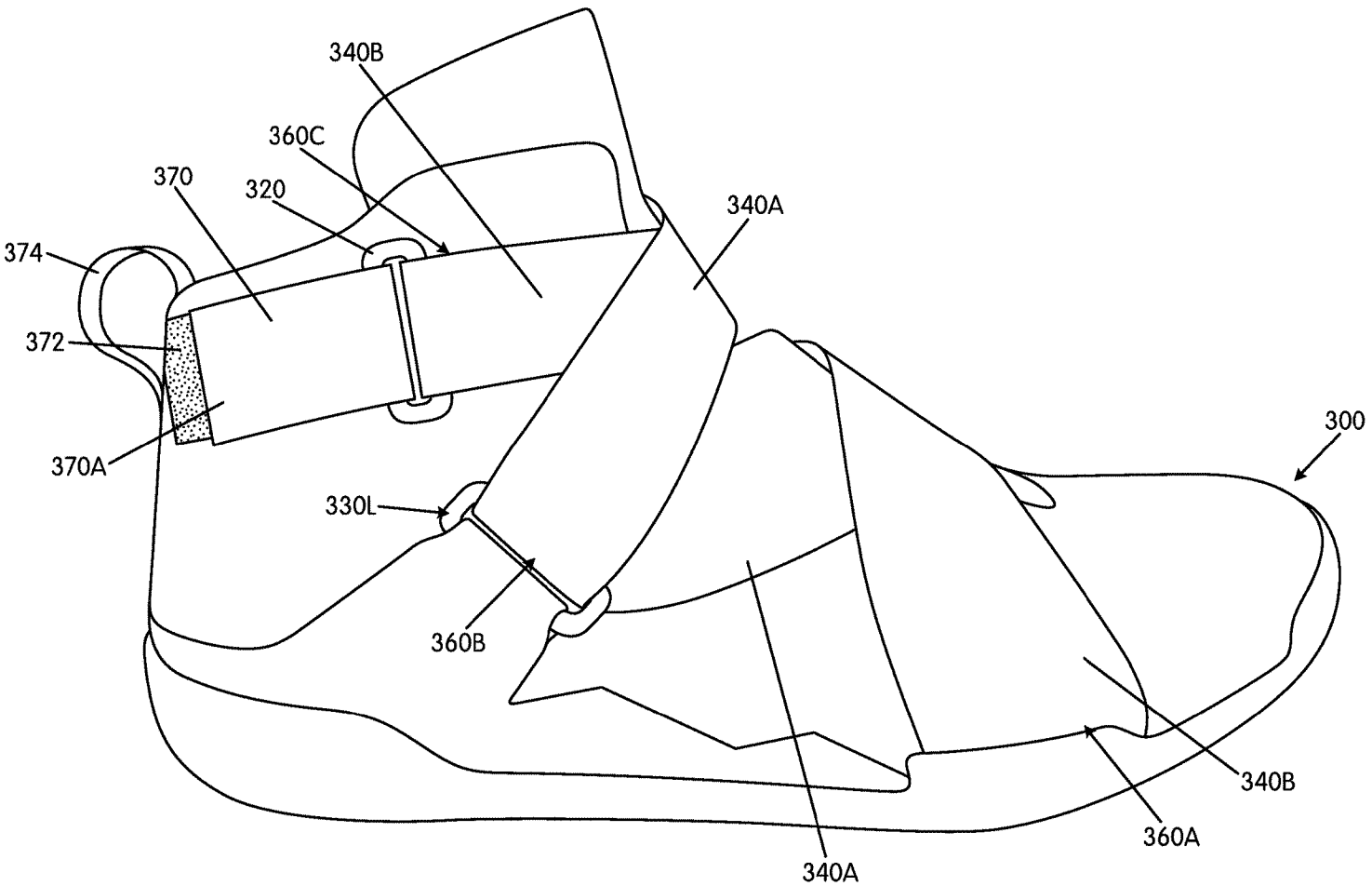
FIGS. 3A through 3C illustrate an article of footwear in accordance with another aspect of this invention, including a different securing system arrangement.
Figure 3B:
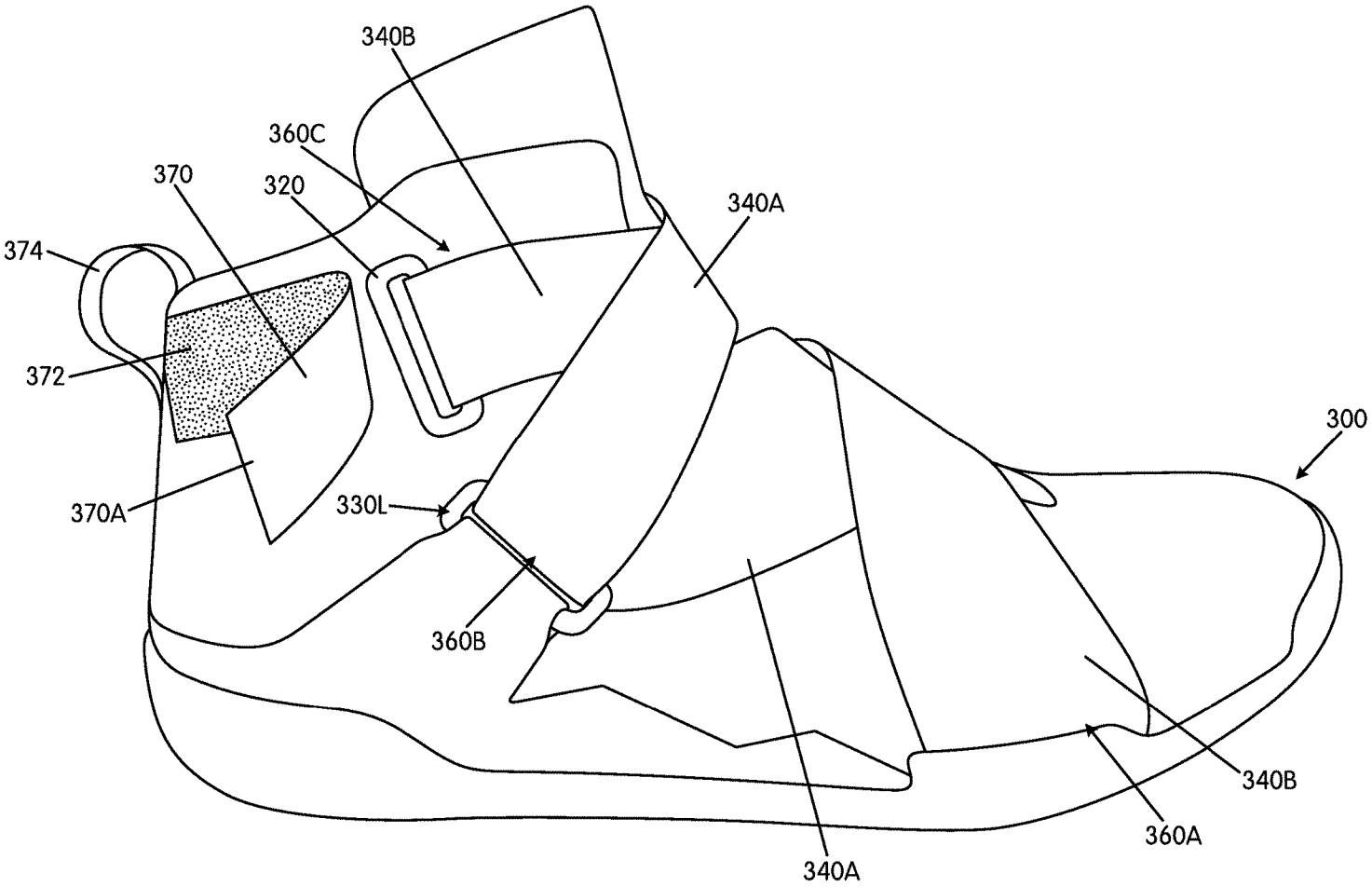
Figure 3C:
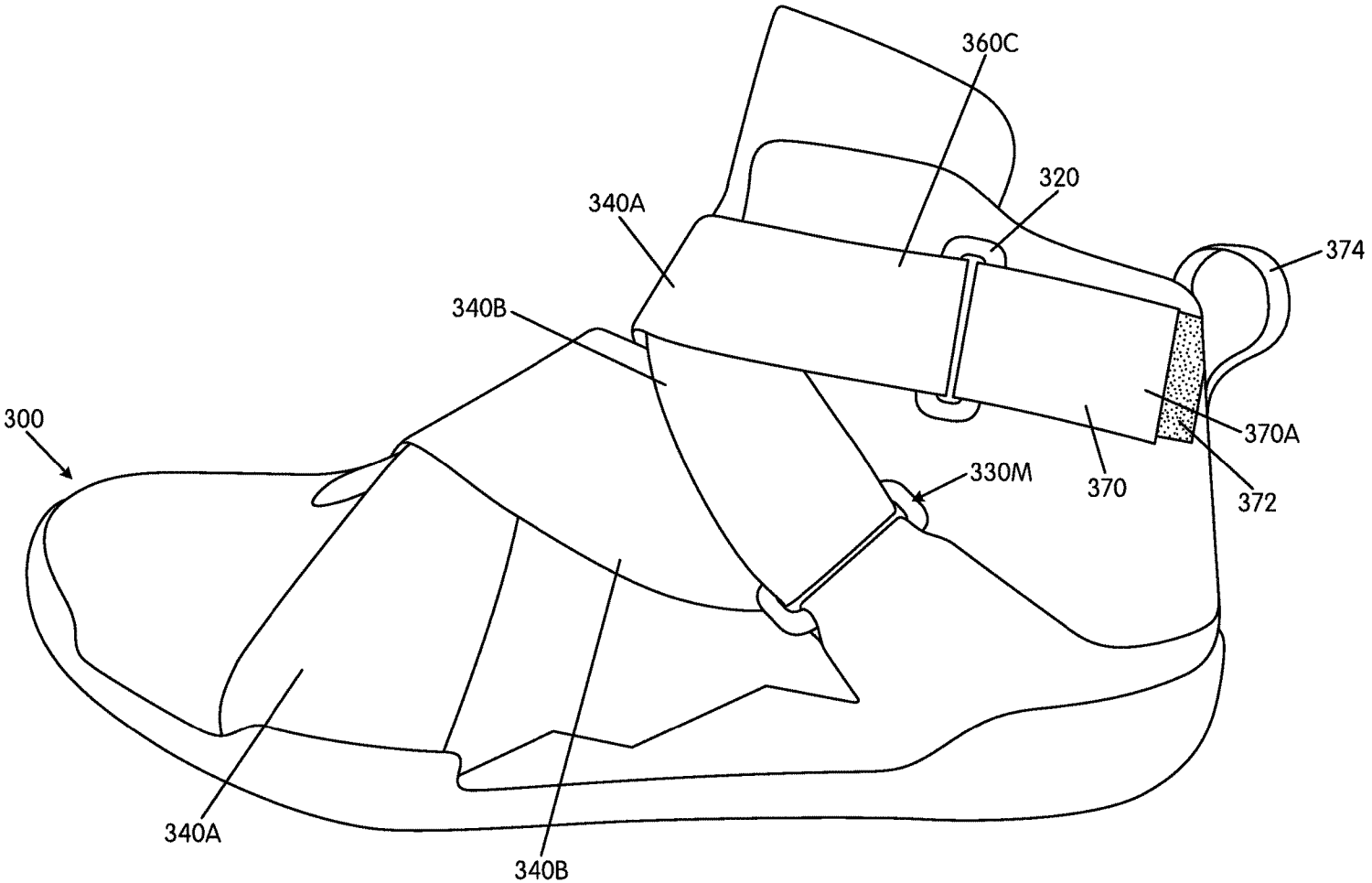
Figure 4A:
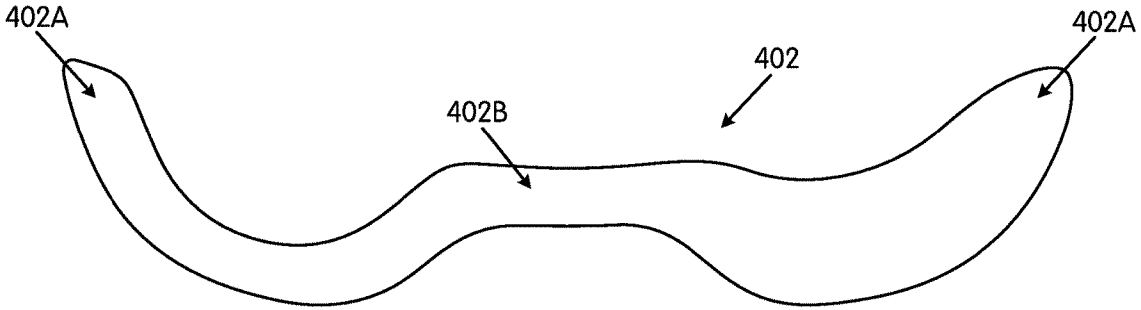
FIGS. 4A through 4E illustrate features of a foam component that may be provided as part of an upper/foot-covering member in footwear/foot-receiving device structures in accordance with at least some examples of this invention (including the footwear structures shown in FIGS. 2A through 3C).
Figure 4B:
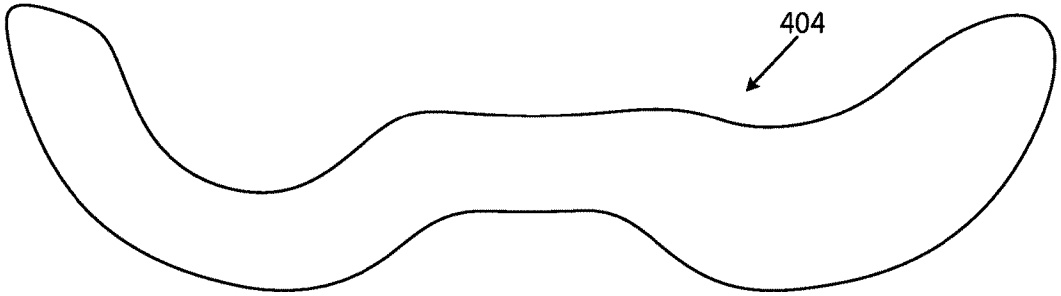
Figure 4D:
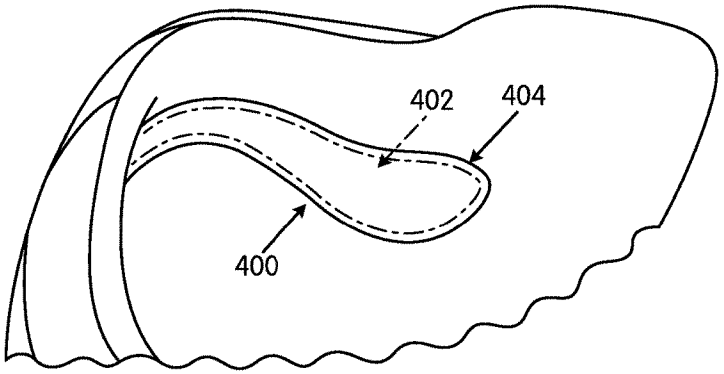
Figure 4C:
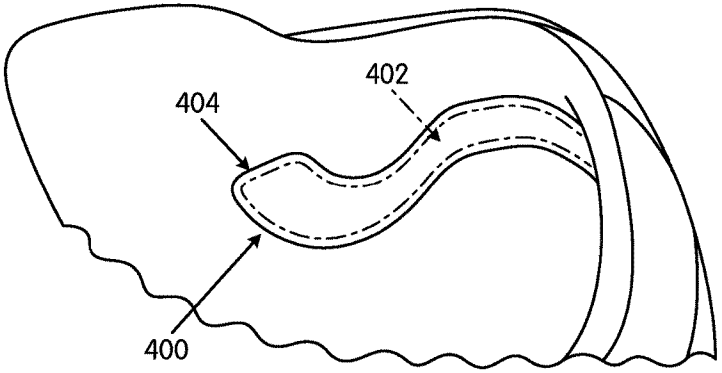
Figure 4E:
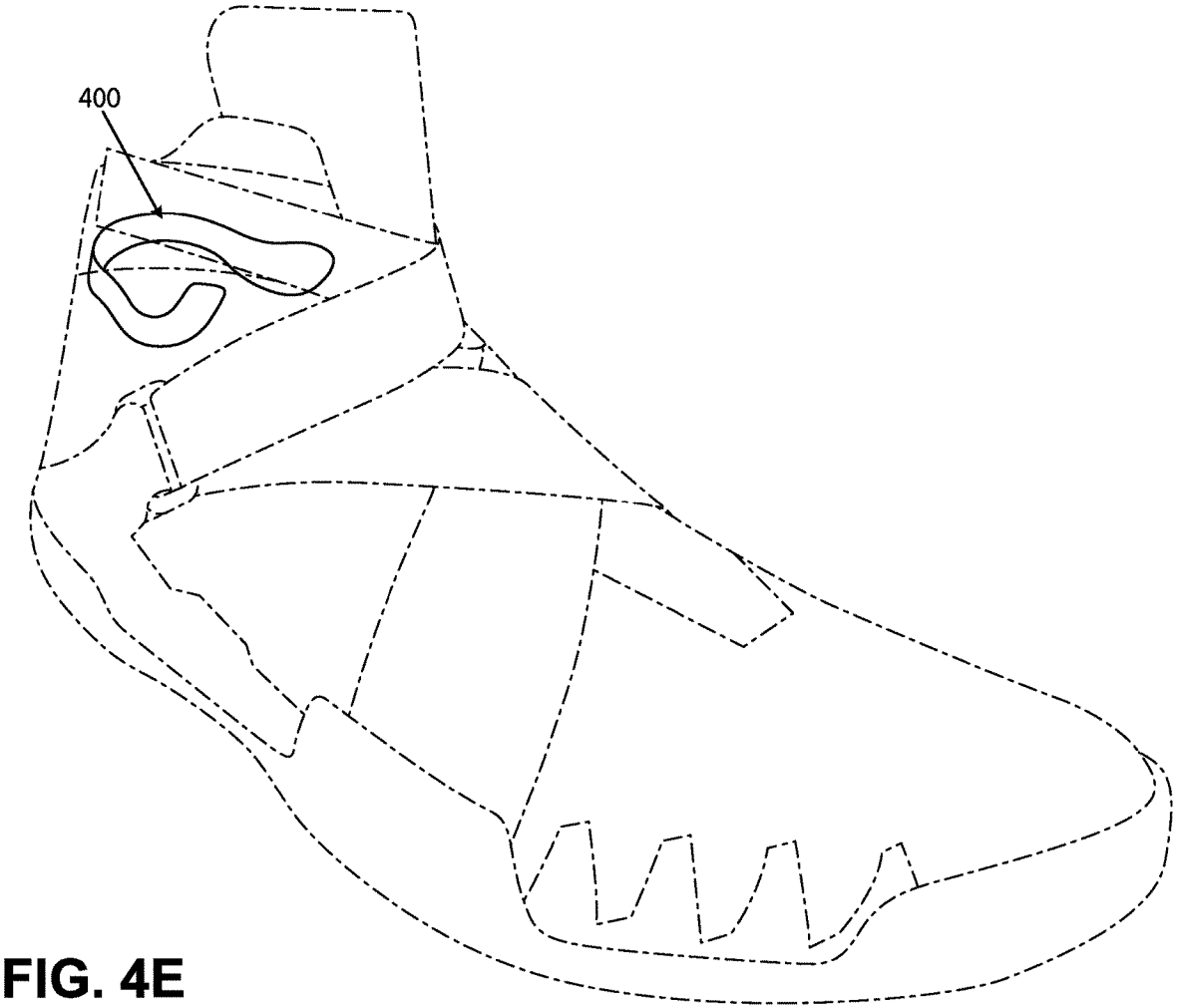

FIGS. 3A-3C illustrate another example article of footwear 300 in accordance with at least some aspects of this invention. FIGS. 3A and 3B show the lateral side of shoe 300 with the strap secured (FIG. 3A) and unsecured (FIG. 3B), and FIG. 3C shows the medial side of the shoe 300. The upper and sole construction of the example shoe 300 of FIGS. 3A-3C may be the same as or similar to those described above with respect to FIGS. 2A-2H. The main differences between shoes 200 and 300 lie in the strap components 340A and 340B and the manner in which the strap components 340A and 340B are secured to tighten the shoe 300 to a wearer's foot.

First, the strap components 340A and 340B of this illustrated example are somewhat wider than the strap components 240A and 240B shown in the illustrated example of FIGS. 2A-2H (e.g., on the larger side of the dimensions and dimension ranges described above, e.g., at the medial and lateral "emerging locations" 360A (e.g., about 55 mm), at the "turning locations" 360B (e.g., about 30 mm), and at the "free ends" 360C (e.g., about 25 mm)). Wide strap components, like those described in conjunction with FIGS. 2A through 3C, may help provide a more comfortable feel as they help disperse pressure applied to the foot by the straps 240A, 240B, 340A, 340B over a wider contact area when the securing system is tightened down on the wearer's foot.

The free ends 360C of the strap components 340A and 340B in this illustrated example structure 300 also differ from the examples shown above in conjunction with FIGS. 2A-2H. In the example of FIGS. 2A-2H, the free ends 246A, 246B of strap portions 240A, 240B included a portion of a securing component (e.g., a portion of a hook-and-loop fastener 248A, 248B) that engaged with another portion of the securing component (e.g., another part of the hook-and-loop fastener 242L, 242M) provided on or as part of the footwear upper 202 at/near the foot-receiving opening area. In the example of FIGS. 3A-3C, however, the free ends 360C of each of the strap components 340A, 340B are equipped (e.g., engaged by sewing, mechanical connectors, etc.) with a strap tensioning component 320. The strap tensioning components 320 may be tensioning components of the types described above with respect to strap tensioning components 230L and 230M (such as a D-ring, an O-ring, a C-ring, etc.).

As shown in FIGS. 3A and 3B, the strap tensioning components 320 at the free end 360C of strap portion 340B engages with a strap element 370 provided at the lateral side of the foot-receiving opening of the shoe 300. The strap element 370 may be engaged with the footwear upper, e.g., by sewing or stitching, by adhesives or cements, by mechanical connectors, etc. In use, the free end 370A of strap element 370 is fed through the tensioning component 320, the strap element 370 is pulled tight around tensioning component 320 and folded back over itself (to thereby tighten strap portion 340B around the wearer's foot, which pulls on a tensioning component (like 330L) on the medial side of the shoe 300), and the free end 370A of the strap element 370 is secured to the upper at the foot-receiving opening area (e.g., via a hook-and-loop fastener, a portion of which is engaged with the strap free end 370A (the underside to that shown in FIG. 3A) and a portion of which is shown as element 372). Similar strap free ends 360C and tensioning components 320 can be provided on strap portion 340A (on the medial side of the shoe 300, as shown in FIG. 3C), and similar strap elements 370, strap free ends 370A, and fastener component(s) 372 can be provided on the other (medial) side of the shoe 300 for pulling strap 340A tight around the tensioning component 330L.

If desired, the strap elements 370 on the lateral and medial sides of the foot-receiving opening may be separate components that are separately engaged with the footwear upper such that one end of the strap element 370 is secured to the upper (and includes the fastener component 372 thereon) and the other end of the strap element 370 is the free end 370A that threads through the tensioning component 320. Alternatively, if desired, a single strap element 370 may wrap around the rear portion of the foot-receiving opening such that the free ends 370A on the lateral and medial sides are opposite ends of a single strap (e.g., and the center of this single strap may be fixed to the upper at the foot-receiving opening area and/or pass through the rear loop 374 around the rear of the upper to join the lateral and medial sides of the strap element 370).

As shown in FIG. 3C, the medial side view of this example shoe structure 300 appears similar to the structures shown in FIG. 2A (with similar components and component placements, etc.), except: (a) the component parts (e.g., turning or tensioning components, etc.) may be changed somewhat to accommodate the wider strap dimensions 340A and 340B and (b) the medial securing system (e.g., the free end of the strap 340A at the foot-receiving opening) has hardware (e.g., tensioning component 320) and is secured (e.g., to a strap 370) in a manner similar to the hardware and securing system shown in FIG. 3A for the lateral side of the shoe.

As evident from FIGS. 3A-3C, this article of footwear 300 is tightened around a wearer's foot by feeding the free ends 370A of straps 370 through the tensioning components 320 provided at the free ends 360C of strap portions 340A and 340B. The free ends 370A of straps 370 are then pulled rearward around tensioning components 320 to tighten the straps 340A and 340B and are secured in place via hook-and-loop fasteners 372 (or other appropriate or desired securing means). This action pulls straps 340A, 340B tight around tensioning components 330L, 330M. Alternatively, if desired, the free ends 370A of straps 340A and 340B could be secured in another manner, such as via a buckle, button, snap, etc., and/or excess strap at the free ends 370A could be secured in a take-up spool or other desired component, excess strap at the free ends 370A could be tied together, etc. As another option or alternative, if desired, one or both of the tensioning components 320 may be provided at a free end of strap 370 and then the free ends 360C of straps 340A and/or 340B could be fed through those tensioning components 320 and secured (e.g., folded back on themselves toward and/or over the instep area and secured via a hook-and-loop fastener or other fastener). Other ways of securing the strap portions 340A and 340B to secure the shoe 300 to the foot also may be used without departing from this invention.

Like the example shown in FIGS. 2A through 2H, the shoe 300 of FIGS. 3A-3C does not include conventional footwear shoelaces and/or eyelets. Rather, the straps 340A, 340B, the tensioning members 330L, 330M, and the strap securing systems (e.g., the rings 320, strap(s) 370, and the securing systems (e.g., hook-and-loop fastener 372, etc.)) may be the main or only manner of securing the article of footwear 300 to the wearer's foot (and/or tightening the shoe to the wearer's foot). Thus, the main components for tightening the shoe 300 to the wearer's foot in at least some example structures in accordance with this example of the invention may consist essentially of: (a) two straps (e.g., 340A, 340B), (b) two tensioning components (e.g., 330L, 330M), and (c) a securing system (e.g., for securing the straps 340A, 340B with the upper (e.g., the rings 320, strap(s) 370, and the securing systems (e.g., hook-and-loop fastener 372, etc.)). Again, eliminating the conventional lace system along with instep area (e.g., as with conventional shoes) may allow the front forefoot area of shoe 300 to be free of laces and/or straps, which can allow the wearer's forefoot and/or toes to move somewhat more freely (e.g., splay out when landing a step or jump, etc.) and thereby improve the overall comfort of the shoe 300 for the wearer.

Alternatively, if desired, shoe structures in accordance with some examples of this invention may include a conventional lacing system (e.g., including a more conventional tongue (not sewn shut and fixed at the instep area), a conventional shoe lace, and conventional eyelets or other lace engaging structures), e.g., located beneath the strap portions 340A, 340B. The inclusion of the additional and more conventional lace features may be useful to provide shoe models that allow the instep area to be opened wider for insertion of the foot (e.g., as compared to the more sewn up, fixed, and closed off tongue and/or instep area shown in the embodiment of FIGS. 3A-3C).

FIGS. 4A-4E illustrate another example feature that may be included in articles of footwear in accordance with at least some examples of this invention, including the articles of footwear 200, 300 shown in FIGS. 2A-3C above. More specifically, FIGS. 4A through 4E show a foam comfort-enhancing element 400 that may be provided around the side and rear heel/Achilles area of the foot. The comfort-enhancing element 400 constitutes a relatively thick foam "pillow" component 402 (FIG. 4A) that is embedded between layers of the footwear upper. More specifically, the foam pillow component 402 is embedded between (a) the outermost footwear upper materials (e.g., materials 212 and 218 from FIGS. 2A and 2B, which may be relatively stiff, to provide support for the foot/ankle, durability, and abrasion resistance) and (b) a soft and smooth interior fabric lining 404 (FIG. 4B, which may be somewhat larger than the foam pillow component 402) at the interior foot-receiving chamber of the shoe for contacting the wearer's foot. Note also FIGS. 4C-4E.

In the final upper product, the ends 402A of the foam pillow component 402 may be located somewhat upward and rearward of the strap turning locations, e.g., the turning locations defined by the tensioning components 230L, 230M, 330L, 330M. Additionally, the central area 402B of the foam pillow component 402 extends around the rear heel/Achilles area of the foot when the shoe is worn. The foam pillow component 402 helps fill in areas around the rear and ankle portion of the foot to provide a more stable and secure feel when the upper is secured to the foot and provide a soft, comfortable feel.

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. An article of footwear, comprising:

an upper defining a foot-insertion opening, a lateral ankle side, a medial ankle side, and an instep area forward of the foot-insertion opening, wherein the upper includes:

a medial strap tensioning component located on the medial ankle side, and a lateral strap tensioning component located on the lateral ankle side;

a sole structure engaged with the upper; and a securing system engaged with the upper, wherein the securing system includes:

a first strap portion having a first terminal end permanently secured on a medial side of the upper, extending across the instep area, engaging the lateral strap tensioning component, extending in front of the foot-insertion opening, and having a second terminal end removably secured to the medial ankle side, and a second strap portion having a first terminal end permanently secured on a lateral side of the upper, extending across the instep area, engaging the medial strap tensioning component, extending in front of the foot-insertion opening, and having a second terminal end removably secured to the lateral ankle side, wherein the first and second strap portions cross one another at two separated crossing locations.

2. An article of footwear according to claim 1, further comprising:

a medial strap securing component located on the medial side of the foot-insertion opening for securing the second end of the first strap portion, wherein the medial strap securing component is located between the foot-insertion opening and the medial strap tensioning component; and a lateral strap securing component located on the lateral side of the foot-insertion opening for securing the second end of the second strap portion, wherein the lateral strap securing component is located between the foot-insertion opening and the lateral strap tensioning component.

3. An article of footwear according to claim 1, wherein the medial strap tensioning component and the lateral strap tensioning component are engaged with a heel reinforcement component that extends around a rear heel area of the upper from the medial strap tensioning component to the lateral strap tensioning component.

4. An article of footwear according to claim 3, wherein the heel reinforcement component includes a heel counter structure.

5. An article of footwear according to claim 1, wherein the article of footwear is a high-top basketball shoe.

6. An article of footwear, comprising:

an upper defining a foot-insertion opening, a lateral side, a medial side, and an instep area, wherein the upper includes:

a medial strap tensioning component located on the medial side of the foot-insertion opening, a lateral strap tensioning component located on the lateral side of the foot-insertion opening, a medial strap securing component located on the medial side of the foot-insertion opening and between the medial strap tensioning component and the foot-insertion opening, and a lateral strap securing component located on the lateral side of the foot-insertion opening and between the lateral strap tensioning component and the foot-insertion opening;

a sole structure engaged with the upper, wherein the upper and the sole structure meet at a medial edge and a lateral edge of the article of footwear; and a securing system engaged with the upper, wherein the securing system includes:

a first strap portion having a first terminal end permanently positioned at the medial edge, extending across the instep area, engaging the lateral strap tensioning component, extending in front of the foot-insertion opening, and having a second terminal end removably secured to the upper with the medial strap securing component, and a second strap portion having a first terminal end permanently positioned at the lateral edge, extending across the instep area, engaging the medial strap tensioning component, extending in front of the foot-insertion opening, and having a second terminal end removably secured to the upper with the lateral strap securing component, wherein the first and second strap portions cross one another at a first crossing location at the instep area of the upper and at a second crossing location located rearward from the first crossing location.

7. An article of footwear according to claim 6, wherein the first strap portion and the second strap portion are provided as separate strap components.

8. An article of footwear according to claim 6, wherein the first strap portion is fixedly engaged between the upper and the sole structure at a first strap engagement location located forward of the first crossing location, and wherein the second strap portion is fixedly engaged between the upper and the sole structure at a second strap engagement location located forward of the first crossing location.

9. An article of footwear according to claim 8, wherein when a bottom surface of the sole structure rests on a horizontal surface:

(a) the sole structure defines a longitudinal direction and a longitudinal length L from a rearmost heel location to a forwardmost toe location, (b) a forward edge of the first strap portion meets the sole structure at the medial edge at a first location forward of a plane perpendicular to the longitudinal direction and located at a position 0.6L along the longitudinal direction, measured forward from the rearmost heel location, and (c) a forward edge of the second strap portion meets the sole structure at the lateral edge at a second location forward of the plane located at position 0.6L.

10. An article of footwear according to claim 8, wherein when a bottom surface of the sole structure rests on a horizontal surface:

(a) the sole structure defines a longitudinal direction and a longitudinal length L from a rearmost heel location to a forwardmost toe location, (b) a rear edge of the first strap portion meets the sole structure at the medial edge at a first location forward of a plane perpendicular to the longitudinal direction and located at a position 0.55L along the longitudinal direction, measured forward from the rearmost heel location, and (c) a rear edge of the second strap portion meets the sole structure at the lateral edge at a second location forward of the plane located at position 0.55L.

11. An article of footwear according to claim 6, wherein the medial strap securing component is a portion of a first hook-and-loop fastener located adjacent the medial side of the foot-insertion opening, and wherein the lateral strap securing component is a portion of a second hook-and-loop fastener located adjacent the lateral side of the foot-insertion opening.

12. An article of footwear according to claim 6, wherein the medial strap tensioning component includes a first component around which the second strap portion wraps to change an extension direction of the second strap portion, and wherein the lateral strap tensioning component includes a second component around which the first strap portion wraps to change an extension direction of the first strap portion.

13. An article of footwear according to claim 6, wherein the medial strap tensioning component includes a first loop through which the second strap portion extends, and wherein the lateral strap tensioning component includes a second loop through which the first strap portion extends.

14. An article of footwear according to claim 6, wherein the medial strap tensioning component defines a medial turning location for the second strap portion and the lateral strap tensioning component defines a lateral turning location for the first strap portion.

15. An article of footwear according to claim 14, wherein when a bottom surface of the sole structure rests on a horizontal surface:

the sole structure defines a longitudinal direction and a longitudinal length L from a rearmost heel location to a forwardmost toe location, (a) at least some portion of the medial turning location is located rearward of a plane perpendicular to the longitudinal direction and located at a position 0.4L along the longitudinal direction, measured forward from the rearmost heel location, and (b) at least some portion of the lateral turning location is located rearward of the plane located at position 0.4L.

16. An article of footwear according to claim 15, wherein when the bottom surface of the sole structure rests on a horizontal surface:

(a) a forward edge of the first strap portion meets the sole structure at the medial edge at a first location forward of a plane perpendicular to the longitudinal direction and located at a position 0.6L along the longitudinal direction, measured forward from the rearmost heel location, and (b) a forward edge of the second strap portion meets the sole structure at the lateral edge at a second location forward of the plane located at position 0.6L.

17. An article of footwear according to claim 15, wherein when the bottom surface of the sole structure rests on a horizontal surface:

a rear edge of the first strap portion meets the sole structure at the medial edge at a first location forward of a plane perpendicular to the longitudinal direction and located at a position 0.55L along the longitudinal direction, measured forward from the rearmost heel location, and (a) a rear edge of the second strap portion meets the sole structure at the lateral edge at a second location forward of the plane located at position 0.55L.

18. An article of footwear according to claim 14, wherein when a bottom surface of the sole structure rests on a horizontal surface:

the sole structure defines a longitudinal direction and a longitudinal length L from a rearmost heel location to a forwardmost toe location, (a) all of the medial turning location is located rearward of a plane perpendicular to the longitudinal direction and located at a position 0.4L along the longitudinal direction, measured forward from the rearmost heel location, and (b) all of the lateral turning location is located rearward of the plane located at position 0.4L.

19. An article of footwear according to claim 18, wherein when the bottom surface of the sole structure rests on a horizontal surface:

a forward edge of the first strap portion meets the sole structure at the medial edge at a first location forward of a plane perpendicular to the longitudinal direction and located at a position 0.6L along the longitudinal direction, measured forward from the rearmost heel location, and (a) a forward edge of the second strap portion meets the sole structure at the lateral edge at a second location forward of the plane located at position 0.6L.

20. An article of footwear according to claim 18, wherein when the bottom surface of the sole structure rests on a horizontal surface:

a rear edge of the first strap portion meets the sole structure at the medial edge at a first location forward of a plane perpendicular to the longitudinal direction and located at a position 0.55L along the longitudinal direction, measured forward from the rearmost heel location, and (a) a rear edge of the second strap portion meets the sole structure at the lateral edge at a second location forward of the plane located at position 0.55L.

21. An article of footwear according to claim 14, wherein when a bottom surface of the sole structure rests on a horizontal surface:

(a) the sole structure defines a longitudinal direction and a longitudinal length L from a rearmost heel location to a forwardmost toe location, (b) at least some portion of the medial turning location is located between two spaced, parallel planes perpendicular to the longitudinal direction and located at positions 0.2L and 0.45L, respectively, along the longitudinal direction, measured forward from the rearmost heel location, and (c) at least some portion of the lateral turning location is located between the two spaced, parallel planes.

22. An article of footwear according to claim 14, wherein when a bottom surface of the sole structure rests on a horizontal surface:

(a) the sole structure defines a longitudinal direction and a longitudinal length L from a rearmost heel location to a forwardmost toe location, (b) all of the medial turning location is located between two spaced, parallel planes perpendicular to the longitudinal direction and located at positions 0.2L and 0.45L, respectively, along the longitudinal direction, measured forward from the rearmost heel location, and (c) all of the lateral turning location is located between the two spaced, parallel planes.

23. An article of footwear according to claim 6, wherein the article of footwear is a basketball shoe.

24. An article of footwear according to claim 6, wherein the article of footwear is a high-top basketball shoe.

* * * * *